US006974234B2

(12) United States Patent
Galli

(10) Patent No.: US 6,974,234 B2
(45) **Date of Patent: *Dec. 13, 2005**

(54) LED LIGHTING ASSEMBLY

(76) Inventor: Robert D. Galli, 8176 Horseshoe Bend La., Las Vegas, NV (US) 89113

( * ) Notice: Subject to any disclaimer, the term of this patent is extended or adjusted under 35 U.S.C. 154(b) by 25 days.

This patent is subject to a terminal disclaimer.

(21) Appl. No.: 10/731,392

(22) Filed: Dec. 9, 2003

(65) Prior Publication Data

US 2004/0114393 A1 Jun. 17, 2004

Related U.S. Application Data

(63) Continuation-in-part of application No. 10/659,575, filed on Sep. 10, 2003, and a continuation-in-part of application No. 10/658,613, filed on Sep. 8, 2003, which is a continuation-in-part of application No. 10/315,336, filed on Dec. 10, 2002.

(60) Provisional application No. 60/338,893, filed on Dec. 10, 2001.

(51) Int. Cl.[7] ..... F21V 29/00

(52) U.S. Cl. ..... 362/294; 362/311; 362/373; 362/555; 362/800

(58) Field of Search ..... 362/373, 92, 555, 362/800, 294, 311, 191, 543–545

(56) References Cited

U.S. PATENT DOCUMENTS 2,224,178 A * 12/1940 Bitner ..... 362/337
4,471,414 A * 9/1984 Savage, Jr. ..... 362/226
4,577,263 A * 3/1986 Maglica ..... 362/187
4,600,977 A * 7/1986 Barlian et al. ..... 362/392
4,733,337 A * 3/1988 Bieberstein ..... 362/206
4,780,799 A * 10/1988 Groh ..... 362/294
4,967,330 A * 10/1990 Bell et al. ..... 362/311
4,991,183 A * 2/1991 Meyers ..... 372/109
5,029,335 A * 7/1991 Fisher et al. ..... 372/36
5,087,212 A * 2/1992 Hanami ..... 439/620
5,126,929 A * 6/1992 Cheselske ..... 362/363
5,368,503 A * 11/1994 Savage, Jr. ..... 439/502
5,528,474 A * 6/1996 Roney et al. ..... 362/545
5,595,435 A * 1/1997 Palmer et al. ..... 362/109

(Continued)

OTHER PUBLICATIONS

LUMILEDS Lighting, LLC, Luxeon Emitter, Technical Datasheet DS25, 12 pages.*

(Continued)

*Primary Examiner*—Stephen Husar
*Assistant Examiner*—Jason Han
(74) *Attorney, Agent, or Firm*—Barlow, Josephs & Holmes, Ltd.

(57) ABSTRACT

The present invention provides a lighting head assembly that incorporates a high intensity LED package into an integral housing for further incorporation into other useful lighting devices. The present invention primarily includes two housing components, namely an inner mounting die and an outer enclosure and an optical component for collimating and focusing the light output. The inner and outer components cooperate to retain the LED package, provide electrical and control connections, provide integral heat sink capacity. Further the integrally incorporated optical lens captures, homogenizes and transmits substantially all of the light emitted by a light source, such as a light emitting diode. The present invention transmits 85% of the light emitted by the light source and produces a uniformly illuminated circular image in the far field of the device. In this manner, high intensity LED packages can be incorporated into lighting assemblies through the use of the present invention by simply installing the present invention into a housing and providing power connections thereto.

15 Claims, 19 Drawing Sheets

U.S. PATENT DOCUMENTS 5,695,275 A * 12/1997 Markiewicz et al. ..... 362/294
5,775,792 A * 7/1998 Wiese ..... 362/328
5,782,555 A * 7/1998 Hochstein ..... 362/373
5,785,418 A * 7/1998 Hochstein ..... 362/373
5,813,743 A * 9/1998 Naka ..... 362/16
5,857,767 A * 1/1999 Hochstein ..... 362/294
6,007,218 A * 12/1999 German et al. ..... 362/259
6,016,038 A * 1/2000 Mueller et al. ..... 315/291
6,019,493 A * 2/2000 Kuo et al. ..... 362/335
6,045,240 A * 4/2000 Hochstein ..... 362/294
6,142,650 A * 11/2000 Brown et al. ..... 362/259
6,161,910 A * 12/2000 Reisenauer et al. ..... 315/309
6,274,924 B1 * 8/2001 Carey et al. ..... 257/676
6,355,946 B1 * 3/2002 Ishinaga ..... 257/98
6,371,636 B1 * 4/2002 Wesson ..... 362/545
6,392,778 B1 * 5/2002 Perduijn et al. ..... 359/245
6,402,347 B1 * 6/2002 Maas et al. ..... 362/294
6,428,189 B1 * 8/2002 Hochstein ..... 362/373
6,441,943 B1 * 8/2002 Roberts et al. ..... 359/267
6,452,217 B1 * 9/2002 Wojnarowski et al. ..... 257/99
6,474,835 B1 * 11/2002 Lin ..... 362/206
6,481,874 B2 * 11/2002 Petroski ..... 362/373
6,517,218 B2 * 2/2003 Hochstein ..... 362/294
6,541,800 B2 * 4/2003 Barnett et al. ..... 257/98
6,547,423 B2 * 4/2003 Marshall et al. ..... 362/333
6,582,100 B1 * 6/2003 Hochstein et al. ..... 362/294
6,737,811 B2 * 5/2004 Zhang et al. ..... 315/56
6,783,260 B2 * 8/2004 Machi et al. ..... 362/259
6,787,999 B2 * 9/2004 Stimac et al. ..... 315/51
6,799,864 B2 * 10/2004 Bohler et al. ..... 362/236
6,819,505 B1 * 11/2004 Cassarly et al. ..... 359/726
6,827,468 B2 * 12/2004 Galli ..... 362/294
2005/0122713 A1 * 6/2005 Hutchins ..... 362/205

OTHER PUBLICATIONS

LUMILEDS Lighting, LLC, Thermal Design Using Luxeon Power Light Sources—Application Brief AB05, 11 pages.*
LUMILEDS Lighting, LLC, Thermal Design Using Luxeon Power Light Sources—Application Brief AB05, 11 pages.*
LUMILEDS Lighting, LLC, Thermal Design Using Luxeon Power Light Sources—Application Brief AB05, 21 pages.*

* cited by examiner

LED LIGHTING ASSEMBLY

CROSS-REFERENCE TO RELATED APPLICATIONS

This application is related to and is a continuation-in-part of U.S. patent application Ser. No. 10/659,575, filed Sep. 10, 2003, which is a continuation-in-part of U.S. patent application Ser. No. 10/315,336, filed Dec. 10, 2002, which claims priority from earlier filed provisional patent application No. 60/338,893, filed Dec. 10, 2001. This application is also related to and is a continuation-in-part of U.S. patent application Ser. No. 10/658,613, filed Sep. 8, 2003.

BACKGROUND OF THE INVENTION

The present invention relates to a new assembly for packaging a high intensity LED lamp for further incorporation into a lighting assembly. More specifically, this invention relates to an assembly for housing a high intensity LED lamp that provides integral electrical connectivity, integral heat dissipation and an integral optical control element in a compact and integrated package for further incorporation into a lighting device.

Currently, several manufacturers are producing high brightness light emitting diode (LED) packages in a variety of forms. These high brightness packages differ from conventional LED lamps in that they use emitter chips of much greater size, which accordingly have much higher power consumption requirements. In general, these packages were originally produced for use as direct substitutes for standard LED lamps. However, due to their unique shape, size and power consumption requirements they present manufacturing difficulties that were originally unanticipated by the LED manufacturers. One example of a high brightness LED of this type is the Luxeon™ Emitter Assembly LED (Luxeon is a trademark of Lumileds Lighting, LLC). The Luxeon LED uses an emitter chip that is four times greater in size than the emitter chip used in standard LED lamps. While this LED has the desirable characteristic of producing a much greater light output than the standard LED, it also generates a great deal more heat than the standard LED. If this heat is not effectively dissipated, it may cause damage to the emitter chip and the circuitry required to drive the LED.

Often, to overcome the buildup of heat within the LED, a manufacturer will incorporate a heat dissipation pathway within the LED package itself. The Luxeon LED, for example, incorporates a metallic contact pad into the back of the LED package to transfer the heat out through the back of the LED. In practice, it is desirable that this contact pad in the LED package be placed into contact with further heat dissipation surfaces to effectively cool the LED package. In the prior art attempts to incorporate these packages into further assemblies, the manufacturers that used the Luxeon LED have attempted to incorporate them onto circuit boards that include heat transfer plates adjacent to the LED mounting location to maintain the cooling transfer pathway from the LED. While these assemblies are effective in properly cooling the LED package, they are generally bulky and difficult to incorporate into miniature flashlight devices. Further, since the circuit boards that have these heat transfer plates include a great deal of heat sink material, making effective solder connections to the boards is difficult without applying a large amount of heat. The Luxeon LED has also been directly mounted into plastic flashlights with no additional heat sinking. Ultimately however, these assemblies malfunction due to overheating of the emitter chip, since the heat generated cannot be dissipated.

Further, because of the large form factor of the emitter chip in these assemblies they tend to emit light over a wide output angle. It is well known in the art that various combinations of lenses and reflectors can be used in conjunction to capture and redirect the wide angle output portion of the radiation distribution of the light emitted. For example, many flashlights available on the market today include a reflector cup around a light source to capture the radiation that is directed from the sides of the light source and redirect it in forward direction, and a convex lens that captures and focuses both the direct output from the light source and the redirected light from the reflector cup. While this is the common approach used in the manufacture of compact lighting devices such as flashlights, this method includes several inherent drawbacks. First, while this arrangement can capture much of the output radiation from the light source, the captured output is only slightly collimated. Light that exits from the light source directly without contacting the reflector surface still has a fairly a wide output angle that allows this direct light output to remain divergent in the far field of the lighting device. Therefore, to collimate this light in an acceptable manner and provide a focused beam, a strong refractive lens must be used. The drawback is that when a lens of this type is used, the image of the light source is directly transferred into the far field of the beam. Second, the light output is not well homogenized using an arrangement of this type. While providing facets on the interior of the reflector surface assists in smearing edges of the image, generally a perfect image of the actual light-generating source is transferred directly into the far field of the beam. In the case of an incandescent, halogen or xenon light source this is an image of a spirally wound filament and in the case of light emitting diodes (LEDs) it is a square image of the emitter die itself. Often this direct transfer of the light source image creates a rough appearance to the beam that is unattractive and distracting for the user of the light. Third, most of these configurations are inefficient and transfer only a small portion of the radiational output into the on axis output beam of the lighting device. Finally, these devices require several separate components to be assembled into mated relation. In this manner, these devices create additional manufacturing and assembly steps that increase the overall cost of the device and increase the chance of defects.

Several prior art catadioptric lenses combine the collector function with a refractive lens in a single device that captures and redirects the radiational output from a light source. U.S. Pat. No. 2,215,900, issued to Bitner, discloses a lens with a recess in the rear thereof into which the light source is placed. The angled sides of the lens act as reflective surfaces to capture light from the side of the light source and direct it in a forward manner using TIR principals. The central portion of the lens is simply a convex element to capture the on axis illumination of the light source and re-image it into the far field. Further, U.S. Pat. No. 2,254,961, issued to Harris, discloses a similar arrangement as Bitner but discloses reflective metallic walls around the sides of the light source to capture lateral radiation. In both of these devices, the on-axis image of the light source is simply an image of the light generating element itself and the lateral radiation is transferred as a circle around the central image. In other words, there is little homogenizing of the light as it passes through the optical assembly. Further, since these devices anticipate the use of a point source type light element, such as is found in filament type lamps, a curvature is provided in the front of the cavity to capture the divergent on axis output emanating from a single point to create a collimated and parallel output. Therefore, a relatively shallow optical curvature is indicated in this application.

Another prior art catadioptric lens is shown in U.S. Pat. No. 5,757,557. This type collimator is referred to as the "flat top tulip" collimator. In its preferred embodiment, it is a solid plastic piece with an indentation at the entrance aperture. The wall of the indentation is a section of a circular cone and the indentation terminates in a shallow convex lens shape. A light source (in an appropriate package) injects its light into the entrance aperture indentation, and that light follows one of two general paths. On one path, it impinges on the inner (conic) wall of the solid collimator where it is refracted to the outer wall and subsequently reflected (typically by TIR) to the exit aperture. On the other path, it impinges on the refractive lens structure, and is then refracted towards the exit aperture. This is illustrated schematically in FIG. 1A. As stated above, the collimator 2 is designed to produce perfectly collimated light 7 from an ideal point source 4 placed at the focal point of the lens 2. A clear limitation is that when it is used with a real extended source 6 of appreciable surface area (such as an LED chip) as seen in FIG. 1B, the collimation is incomplete and the output is directed into a diverging conic beam that includes a clear image of the chip as a central high intensity region 8 and a secondary halo region 9.

When a high intensity light source if manufactured using the prior art structures disclosed above, the device quickly becomes quite large in order to allow for all of the required tolerances and to accommodate the desired functionality. There is therefore a need for a compact assembly that provides for the mounting of a high intensity LED package that includes a great deal of heat transfer potential in addition to providing a high level of optical control of the light output thereby facilitating the incorporation of the LED into an overall lighting assembly. There is a further need for a compact lighting assembly that includes a high level of optical control through the use of a catadioptric lens assembly that collimates the light output from a light source while also homogenizing the output to produce a smoothly illuminated and uniform beam image in the far field of the device and includes integral means for dissipating the waste heat generated by the light source.

BRIEF SUMMARY OF THE INVENTION

In this regard, the present invention provides an assembly that incorporates a high intensity LED package, such as the Luxeon Emitter Assembly described above, into an integral housing for further incorporation into other useful lighting devices. The present invention can be incorporated into a variety of lighting assemblies including but not limited to flashlights, specialty architectural grade lighting fixtures and vehicle lighting. The present invention primarily includes two housing components, namely an inner mounting die, and an outer enclosure. The inner mounting die is formed from a highly thermally conductive material. While the preferred material is brass, other materials such as thermally conductive polymers or other metals may be used to achieve the same result. The inner mounting die is cylindrically shaped and has a recess in the top end. The recess is formed to frictionally receive the mounting base of a high intensity LED assembly. A longitudinal groove is cut into the side of the inner mounting die that may receive an insulator strip or a strip of printed circuitry, including various control circuitry thereon. Therefore, the inner mounting die provides both electrical connectivity to one contact of the LED package and also serves as a heat sink for the LED. The contact pad at the back of the LED package is in direct thermal communication with the inner surface of the recess at the top of the inner mounting die thus providing a highly conductive thermal path for dissipating the heat away from the LED package.

The outer enclosure of the present invention is preferably formed from the same material as the inner mounting die. In the preferred embodiment, this is brass but may be thermally conductive polymer or other metallic materials. The outer enclosure slides over the inner mounting die and has a circular opening in the top end that receives the clear optical portion of the Luxeon LED package therethrough. The outer enclosure serves to further transfer heat from the inner mounting die and the LED package, as it is also highly thermally conductive and in thermal communication with both the inner mounting die and the LED package. The outer enclosure also covers the groove in the side of the inner mounting die protecting the insulator strip and circuitry mounted thereon from damage.

Additionally, the present invention includes an optical element coupled with the mounting assembly that is well suited for use with LED light sources, which do not approximate a point source for luminous flux output. The optical element includes a recessed area into which the light source is placed. The front of the recess further includes an inner lens area for gathering and focusing the portion of the beam output that is emitted by the light source along the optical axis of the optical attachment. Further, the optical attachment includes an outer reflector area for the portion of the source output that is directed laterally or at large angles relative to the optical axis of the device. The reflector portion and the inner lens direct the light output through a transition region where the light is focused and homogenized. The convex optics at the front of the transition region images this focused and homogenized light into the far field of the device. Assembled in this manner, the present invention can be incorporated into any type of lighting device.

Accordingly, one of the objects of the present invention is the provision of an assembly for packaging a high intensity LED. Another object of the present invention is the provision of an assembly for packaging a high intensity LED that includes integral heat sink capacity. A further object of the present invention is the provision of an assembly for packaging a high intensity LED that includes integral heat sink capacity while further providing means for integral electrical connectivity and control circuitry. Yet a further object of the present invention is the provision of an assembly for packaging a high intensity LED that includes integral heat sink capacity and a one piece optical assembly that can be used to capture both the on axis and lateral luminous output and collimate the output to create a homogenous beam image in the far field of the device. A further object of the present invention is the provision of an assembly for packaging a high intensity LED that includes integral heat sink capacity and an integrated optical assembly that creates a homogenous and focused beam image on the interior thereof that is further imaged into the far field of the output beam of the device to create a low angle beam divergence.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE INVENTION

Figure 1A:
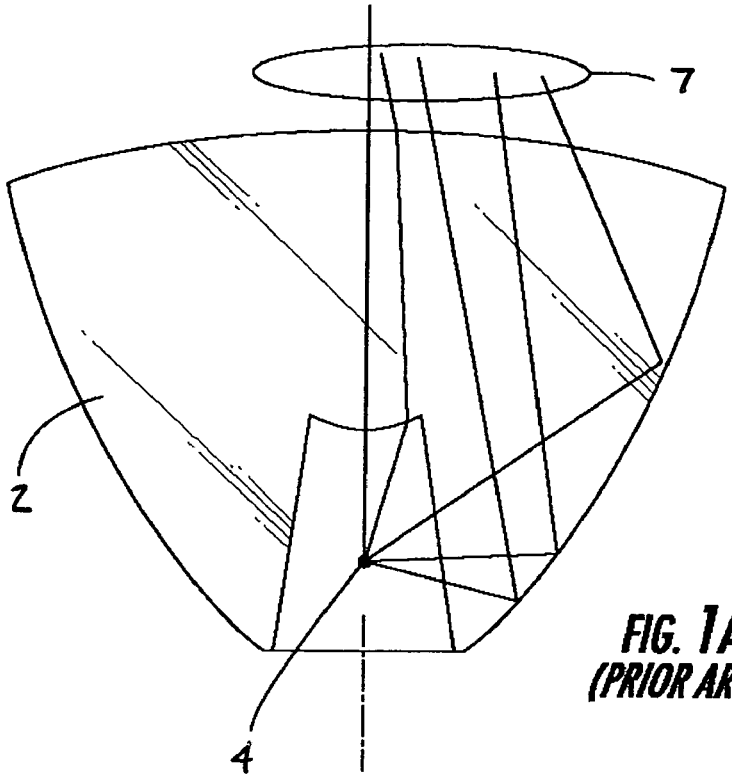
FIG. 1A (PRIOR ART)
FIG. 1A is a cross-sectional view of a prior art catadioptric lens showing ray traces from a theoretical point source.

Referring now to the drawings, the light emitting diode (LED) lighting assembly of the present invention is illustrated and generally indicated at 1. The lighting assembly 1 generally includes an LED and heat sink sub-assembly 10 and an optical assembly 60 that are contained and maintained in spaced relation within an outer housing 62. As will hereinafter be more fully described, the present invention illustrates an LED lighting assembly 1 for further incorporation into a lighting device. For the purposes of providing a preferred embodiment of the present invention, the device 1 will be shown incorporated into a generic housing 62 with two power supply leads 64, 66 extending therefrom, however, the present invention also may be incorporated into any other lighting device such as architectural specialty lighting, vehicle lighting, portable lighting or flashlights. In general, the present invention provides a means for packaging a high intensity LED lamp that includes integral heat sink capacity, electrical connectivity and an optical assembly for controlling the light output from the LED. The present invention therefore provides a convenient and economical assembly 1 for incorporating a high intensity LED into a lighting assembly that has not been previously available in the prior art.

Figure 2:
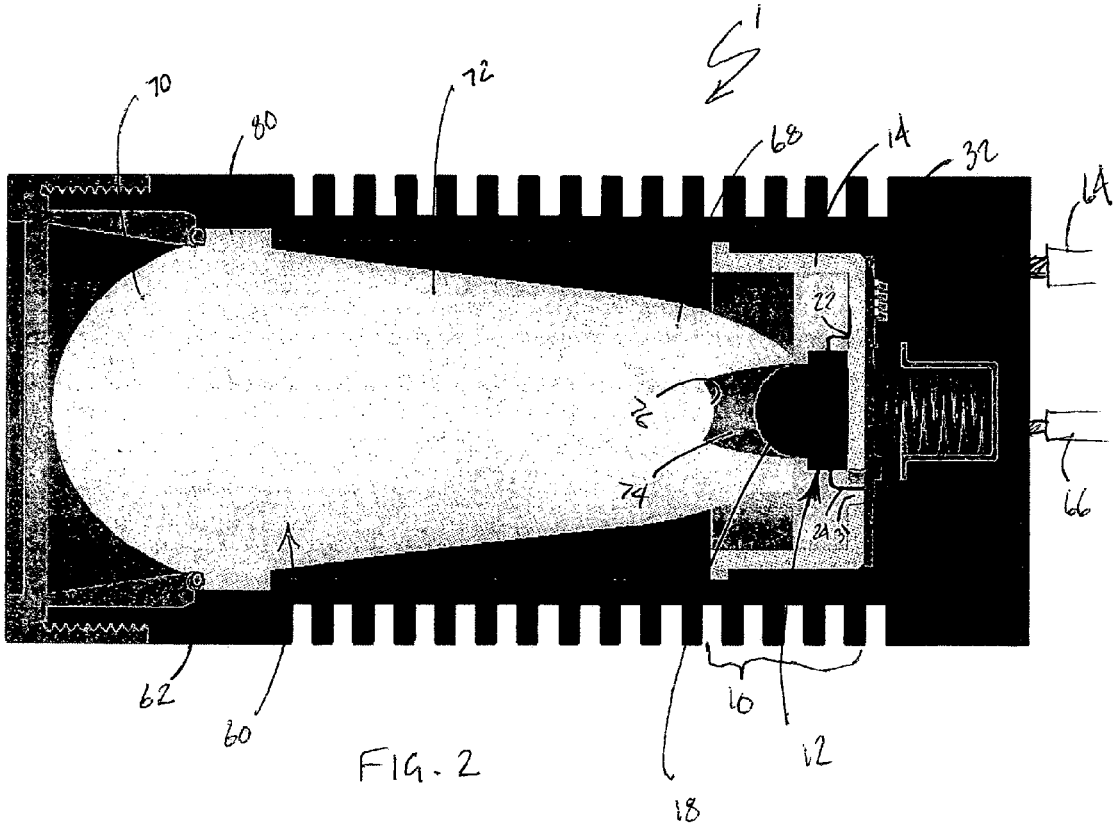
FIG. 2 is a perspective view of the LED lighting assembly of the present invention.
Figure 3:
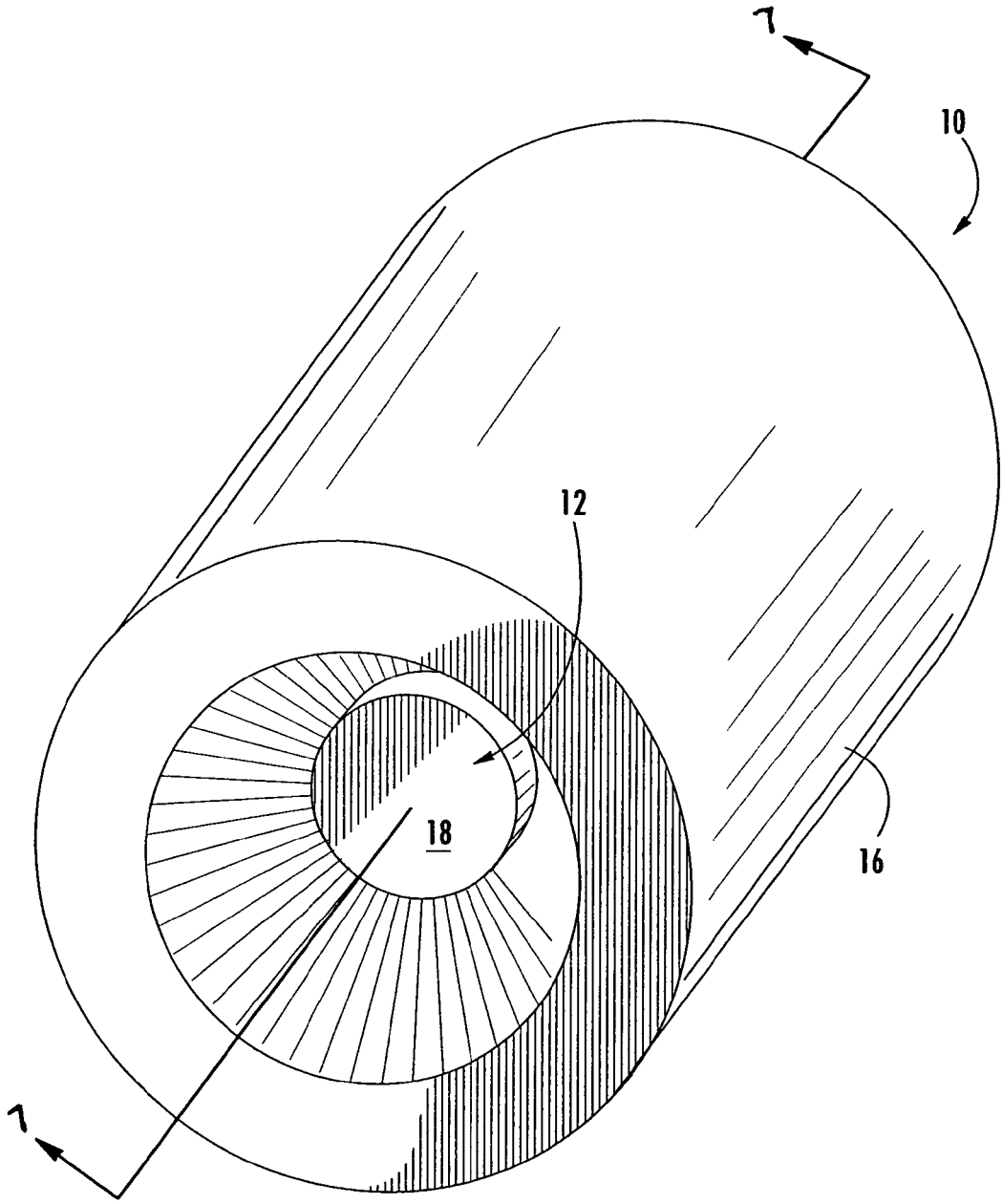
FIG. 3 is a perspective view of the LED and heat sink sub-assembly portion of the present invention.
Figure 4:
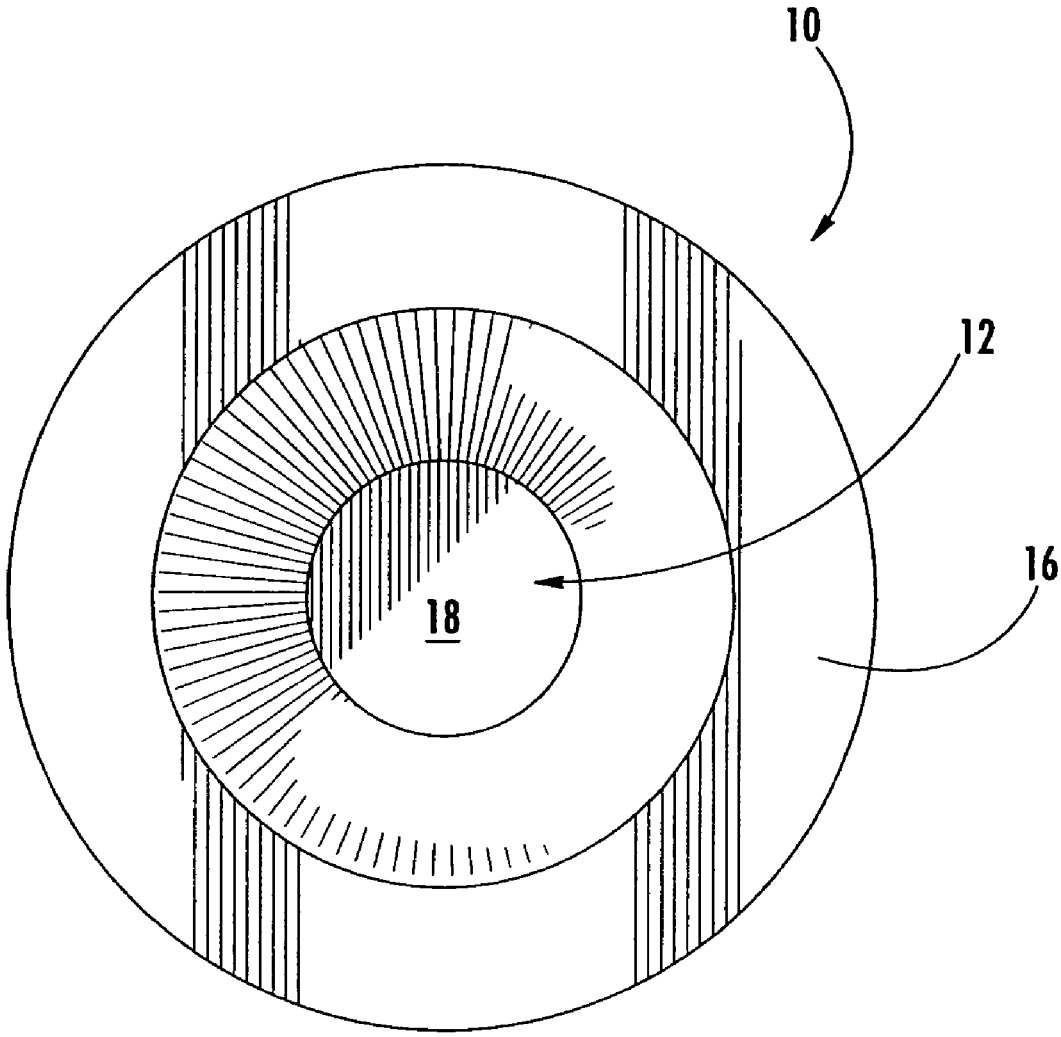
FIG. 4 is a front view thereof.
Figure 5:
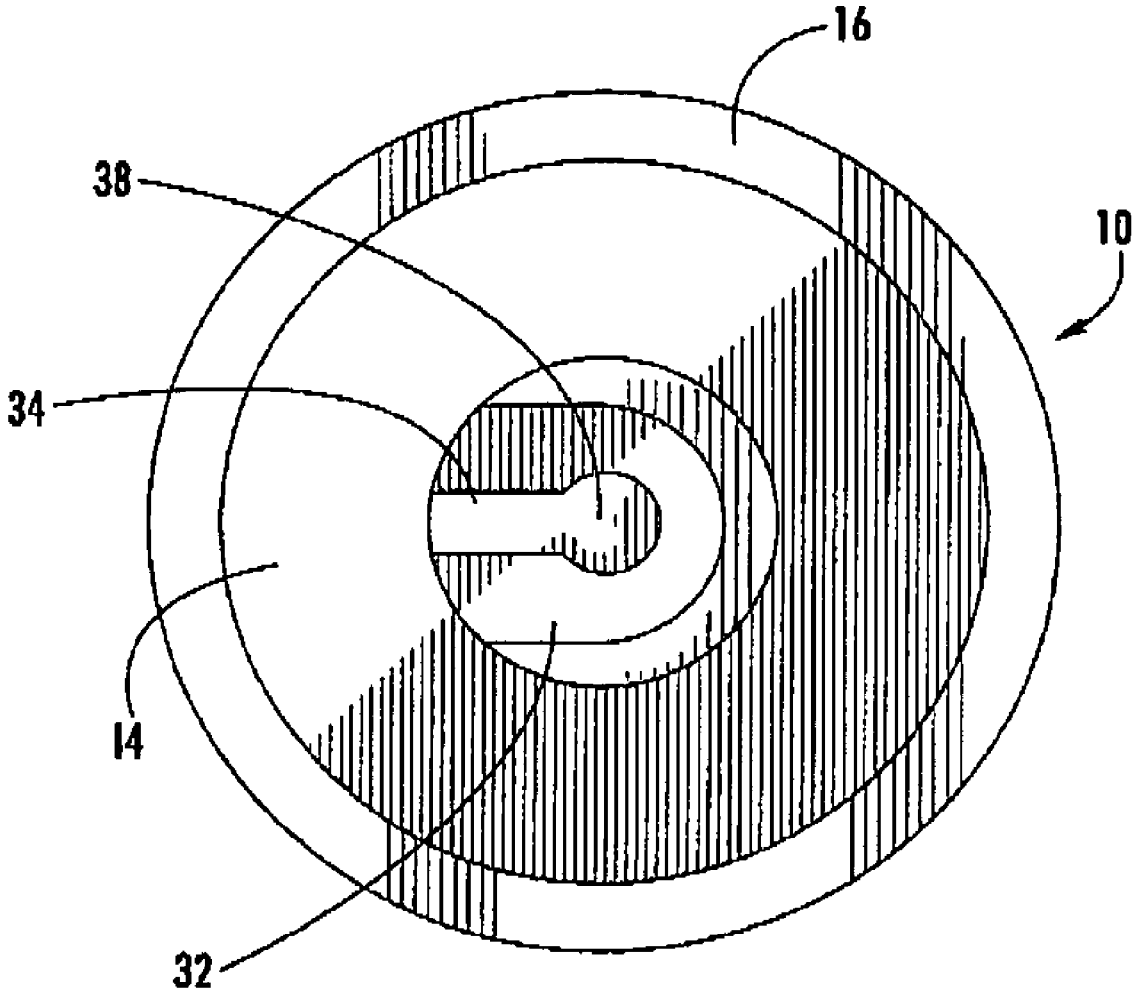
FIG. 5 is rear view thereof.

Turning to FIG. 2, the LED, heat sink and optic assembly 1 can be seen in a fully assembled state and includes one embodiment of an LED and heat sink sub-assembly 10. The main parts of the sub-assembly 10 can be seen to include a high intensity LED lamp 12 and an inner mounting die 14. In an alternate embodiment, as is shown in FIGS. 3–7, the sub-assembly may also include outer enclosure 16. In FIGS. 2 and 3, the lens 18 of the LED 12 can be seen extending through an opening in the front wall of the outer enclosure 16. Further, in FIG. 5, a rear view of the sub-assembly 10 of the present invention can be seen with a flexible contact strip 32 shown extending over the bottom of the interior die 14.

Figure 6:
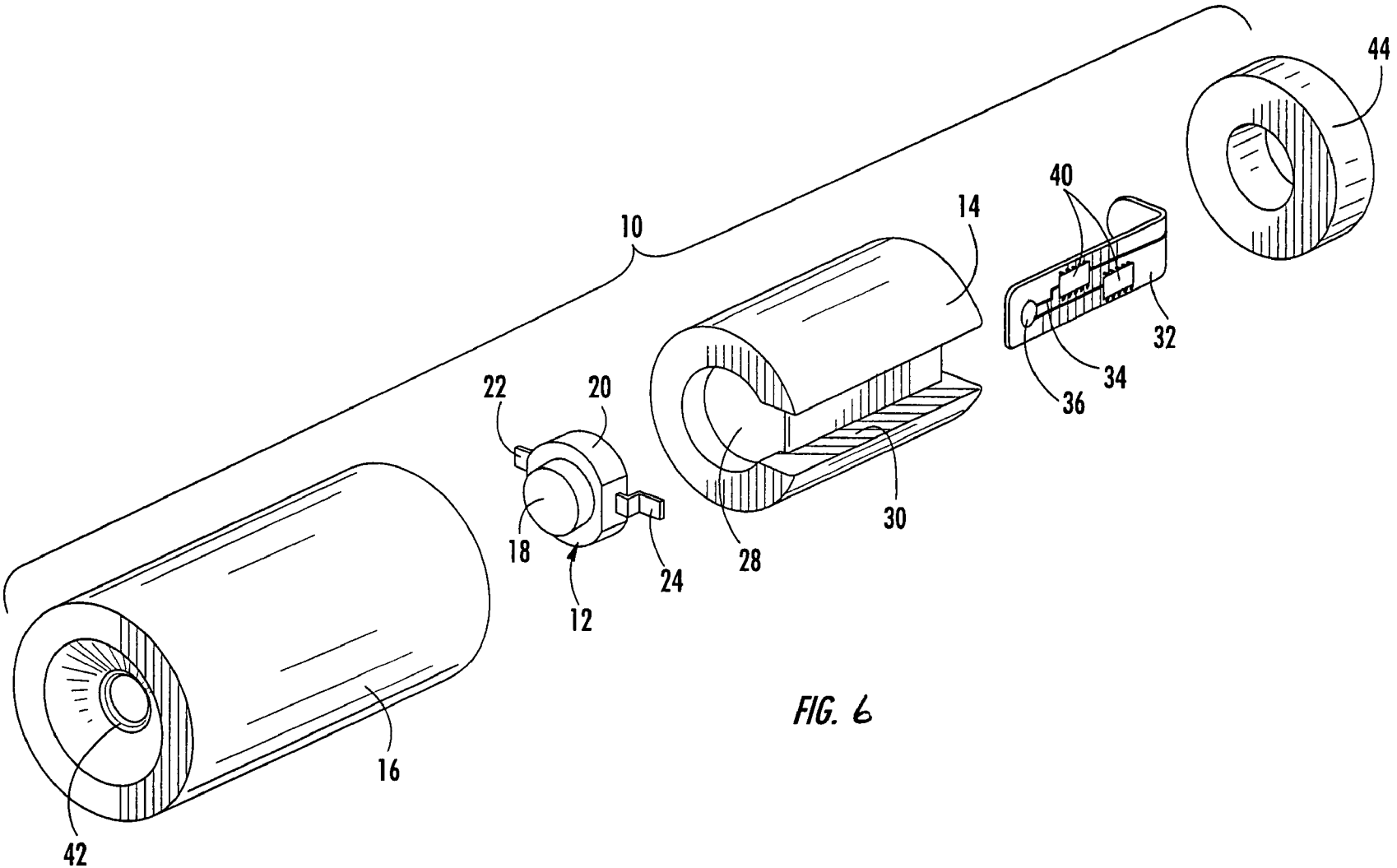
FIG. 6 is an exploded perspective thereof.
Figure 7:
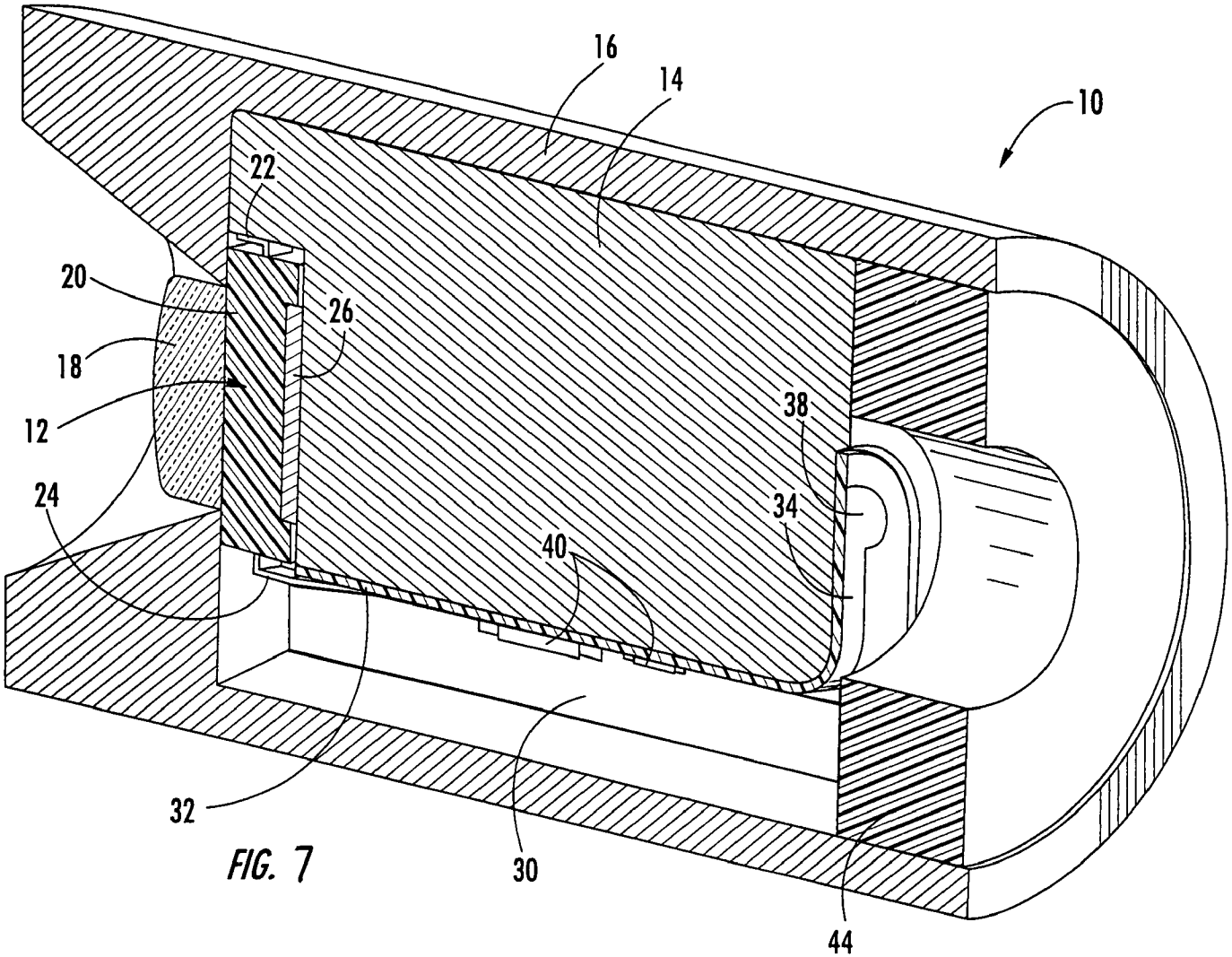
FIG. 7 is a cross-sectional view thereof as taken along line 7—7 of FIG. 3.

Turning now to FIGS. 6 and 7, an exploded perspective view and a cross sectional view of the sub-assembly 10 of the present invention can be seen. The sub-assembly 10 of the present invention is specifically configured to incorporate a high intensity LED lamp 12 into a package that can be then used in a lighting assembly. The high intensity LED lamp 12 is shown here as a Luxeon Emitter assembly. However, it should be understood that the mounting arrangement described is equally applicable to other similarly packaged high intensity LED's. The LED 12 has a mounting base 20 and a clear optical lens 18 that encloses the LED 12 emitter chip (not shown). The LED 12 also includes two contact leads 22, 24 that extend from the sides of the mounting base 20, to which power is connected to energize the emitter chip. Further, the LED lamp 12 includes a heat transfer plate 26 positioned on the back of the mounting base 20. Since the emitter chip in this type of high intensity LED lamp 12 is four times the area of a standard emitter chip, a great deal more energy is consumed and a great deal more heat is generated. The heat transfer plate 26 is provided to transfer waste heat out of the LED lamp 12 to prevent malfunction or destruction of the chip. In this regard, the manufacturer has provided the heat transfer plate 26 for the specific purpose of engagement with a heat sink. However, all of the recommended heat sink configurations are directed to a planar circuit board mount with a heat spreader or a conventional finned heat sink. Neither of these arrangements is suitable for small package integration or a typical compact lighting head construction.

In contrast, the mounting die 14 used in the present invention is configured to receive the LED lamp 12 and further provide both electrical and thermal conductivity to and from the LED lamp 12. The mounting die 14 is fashioned from a thermally conductive and electrically conductive material. In the preferred embodiment as can be seen in FIG.2, the mounting die 14 is fashioned from aluminum, however, the die 14 could also be fabricated from other metals such as brass or stainless steel or from an electrically conductive and thermally conductive polymer composition and still fall within the scope of this disclosure. The mounting die 14 has a recess 28 in one end thereof that is configured to receive the base 20 of the LED lamp 12. While the base 20 and the recess 28 are illustrated as circular, it is to be understood that this recess is intended to receive the housing base regardless of the shape. As can be seen, one of the contact leads 22 extending from the base 20 of the LED lamp 12 must be bent against the surface of the mounting die 14 when the LED lamp 12 is installed into the recess 28. When installed with the first contact lead 22 of the LED 12 retained in this manner, the lead 22 is in firm electrical communication with the mounting die 14. An aperture 31 extends through the mounting die 14 from the recess to the rear of the die 14. When the LED lamp 12 is installed in the mounting die 14, the second contact lead 24 extends into the aperture 31 out of contact with the body of the mounting die 14. The heat transfer plate 26 provided in the rear of the LED lamp 12 base 20 is also in contact with the bottom wall of the recess 28 in the mounting die 14. When the heat transfer plate 26 is in contact with the die 14, the heat transfer plate 26 is also in thermal communication with the die 14 and heat is quickly transferred out of the LED lamp 12 and into the body of the die 14. The die 14 thus provides a great deal of added heat sink capacity to the LED lamp 12.

Further, in FIG. 2, a circuit board 32 is shown installed adjacent the back of the inner mounting die 14. As can be seen, the second contact lead 24 of the LED 12 extends through the aperture 31 in the inner mounting die 14. The contact lead 24 extends through the aperture without contacting the inner mounting die 14. The contact lead 24 extends to the circuit board 32 and is in electrical communication with the circuit board 32. The inner mounting die 14 is in both thermal and electrical communication with the outer housing 62.

Similarly, in an alternate embodiment heat sink sub assembly 10 as can best be seen in FIG. 7, the circuit board strip 32 is placed into the bottom of the channel 30 that extends along the side of the mounting die 14. The circuit board strip 32 allows a conductor to be connected to the second contact lead 24 of the LED lamp 12 and extended through the channel 30 to the rear of the sub-assembly 10 without coming into electrical contact with and short circuiting against the body of the die 14. In the preferred embodiment, the circuit board strip 32 in this embodiment is a flexible printed circuit strip with circuit traces 34 printed on one side thereof. The second contact lead 24 of the LED lamp 12 is soldered to a contact pad 36 that is connected to a circuit trace 34 at one end of the circuit board strip 32. The circuit trace 34 then extends the length of the assembly and terminated in a second contact pad 38 that is centrally located at the rear of the assembly 10. Further, control circuitry 40 may be mounted onto the flexible circuit strip 32 and housed within the channel 30 in the die 14. The control circuitry 40 includes an LED driver circuit as is well known in the art.

With the LED lamp 12 and circuit board strip 32 installed on the mounting die 14, the mounting die 14 is inserted into the outer enclosure 16. The outer enclosure 16 is also fashioned from a thermally conductive and electrically conductive material. In the preferred embodiment the outer enclosure 16 is fashioned from brass, however, the outer enclosure 16 could also be fabricated from other metals such as aluminum or stainless steel or from an electrically conductive and thermally conductive polymer composition and still fall within the scope of this disclosure. The outer enclosure 16 has a cavity that closely matches the outer diameter of the mounting die 14. When the mounting die 14 is received therein, the die 14 and the housing 16 are in thermal and electrical communication with one another, providing a heat transfer pathway to the exterior of the sub-assembly 10. As can also be seen, electrical connections to the sub-assembly 10 can be made by providing connections to the outer enclosure 16 and the contact pad 38 on the circuit trace 34 at the rear of the mounting die 14. Typically this electrical connectivity will be extended utilizing electrical leads 64, 66 to extend the connection means further away from the sub-assembly 10 to facilitate connections being made thereto. The outer enclosure 16 also includes an aperture 42 in the front wall thereof through which the optical lens portion 18 of the LED lamp 12 extends.

Finally, an insulator disk 44 is shown pressed into place in the open end of the outer enclosure 16 behind the mounting die 14. The insulator disk 44 fits tightly into the opening in the outer enclosure 16 and serves to retain the mounting die 14 in place and to further isolate the contact pad 38 at the rear of the mounting die 14 from the outer enclosure 16.

Figure 8:
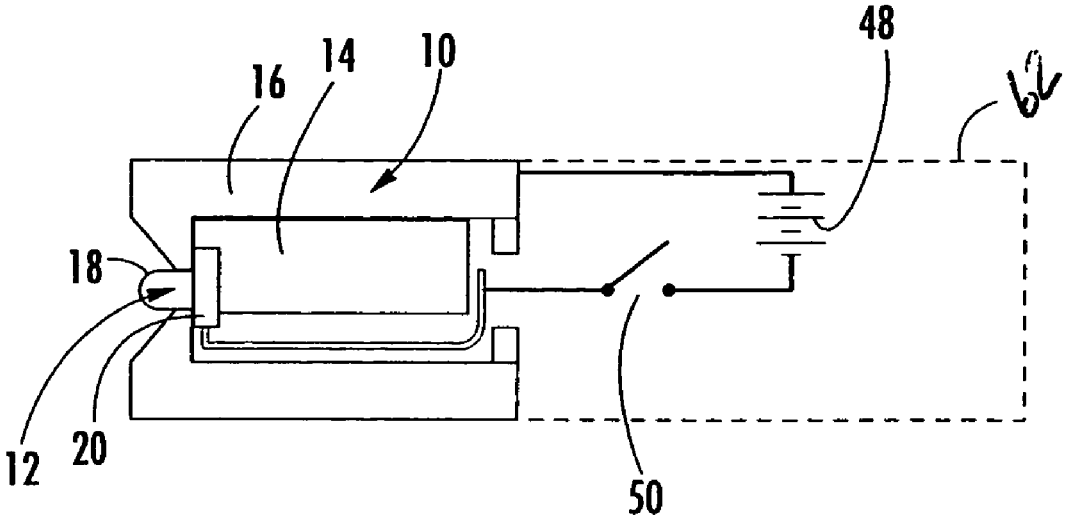
FIG. 8 is a schematic diagram generally illustrating the operational circuitry of present invention as incorporated into a complete lighting assembly.

Turning now to FIG. 8, a schematic diagram of a completed circuit showing the LED sub-assembly 10 of the present invention incorporated into functional lighting device is provided. The LED sub-assembly 10 is shown with electrical connections made thereto. A housing 62 is provided and shown in dashed lines. A power source 48 is shown within the housing 62 with one terminal in electrical communication with the outer enclosure 15 of the LED assembly 10 and a second terminal in electrical communication with the circuit trace 38 at the rear of the housing 16 via a switch assembly 50. The switching assembly 50 is provided as a means of selectively energizing the circuit and may be any switching means already known in the art. The housing 62 of the lighting device may also be thermally and electrically conductive to provide additional heat sink capacity and facilitate electrical connection to the outer enclosure 16 of the LED sub-assembly 10.

Figure 9:
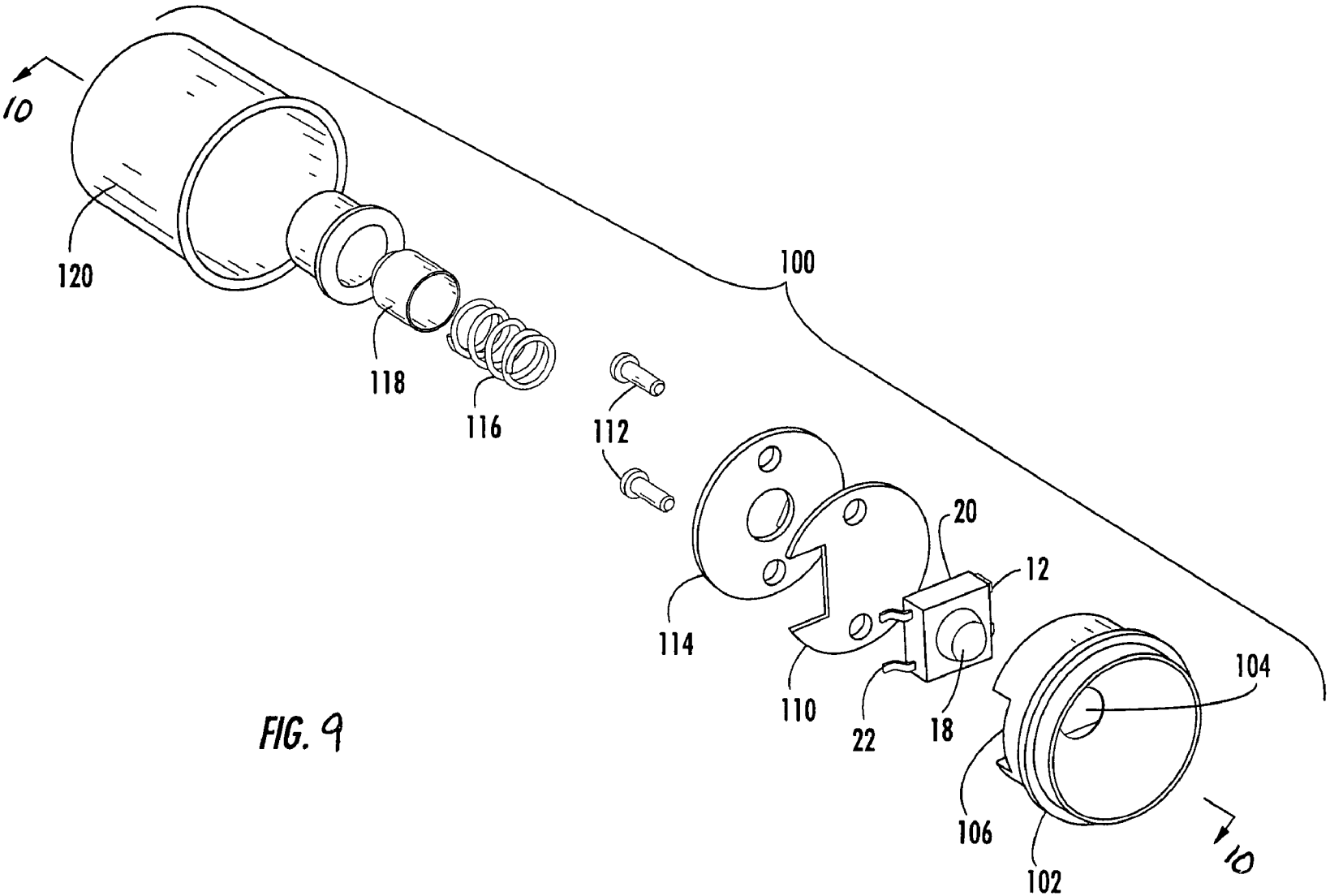
FIG. 9 is an exploded perspective view of a first alternate embodiment of the present invention.
Figure 10:
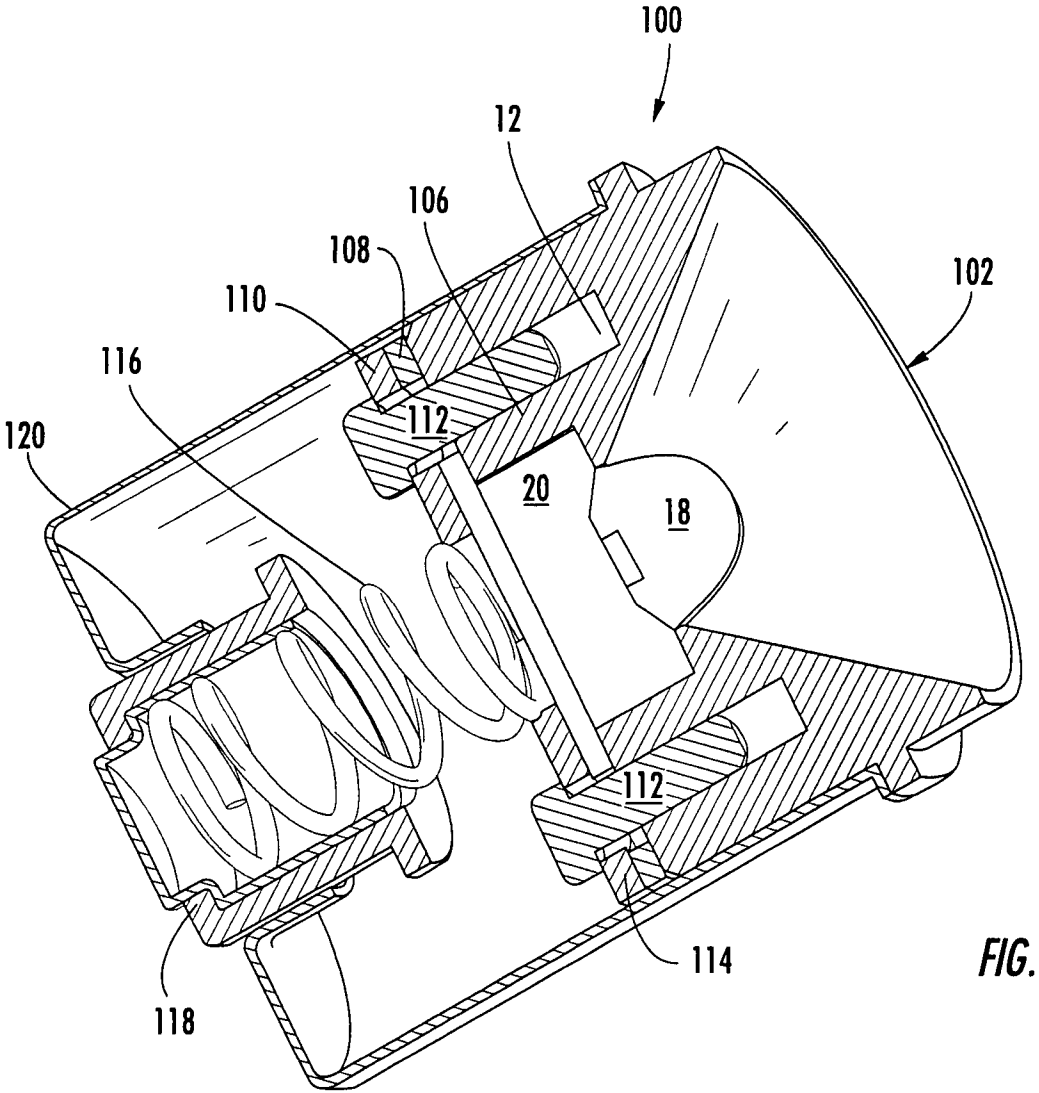
FIG. 10 is a cross-sectional view thereof as taken along line 10—10 of FIG. 9.

Turning to FIGS. 9 and 10, an alternate embodiment of the LED assembly 100 is shown the outer enclosure is a reflector cup 102 with an opening 104 in the center thereof. The luminescent portion 18 of the LED 12 is received in the opening 104. The reflector cup 102 includes a channel 106 that is cleared in the rear thereof to receive the mounting base 20 of the LED 12 wherein the rear surface of the mounting base 20 is substantially flush with the rear surface 108 of the reflector cup 102 when the LED in 12 is in the installed position. The mounting die is replaced by a heat spreader plate 110. The spreader plate 110 is in thermal communication with both the heat transfer plate on the back of the LED 12 and the rear surface 108 of the reflector cup 102. In this manner when the LED 12 is in operation the waste heat is conducted from the LED 12 through the spreader plate 110 and into the body of the reflector cup 102 for further conduction and dissipation. The spreader plate 110 may be retained in its operative position by screws 112 that thread into the back 108 of the reflector cup 102. Alternatively, a thermally conductive adhesive (not shown) may be used to hold the LED 12, the reflector cup 102 and the spreader plate 110 all in operative relation.

FIGS. 9 and 10 also show the installation of a circuit board 114 installed behind the spreader plate 110. The circuit board 114 is electrically isolated from the spreader plate 110 but has contact pads thereon where the electrical contacts 22 of the LED 12 can be connected. Further a spring 116 may be provided that extends to a plunger 118 that provides an means for bringing power from one battery contact into the circuit board 114. Power from the second contact of the power source may be conducted through the outer housing 120 and directed back to the circuit board. While specific structure is shown to complete the circuit path, it can be appreciated that the present invention is primarily directed to the assembly including merely the reflector cup 102, the LED 12 and the spreader plate 110.

Figure 11:
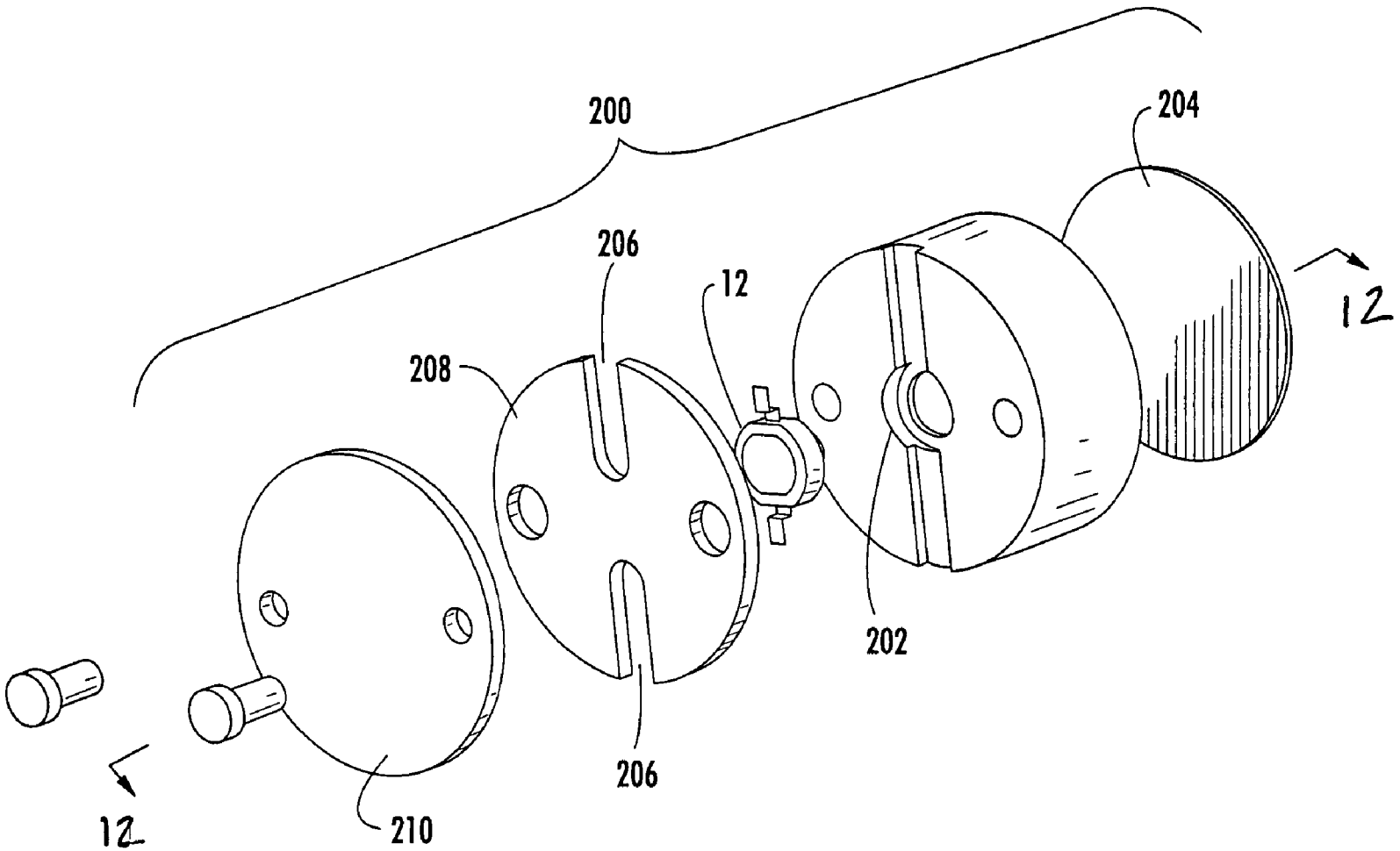
FIG. 11 is an exploded perspective view of a second alternate embodiment of the present invention.
Figure 12:
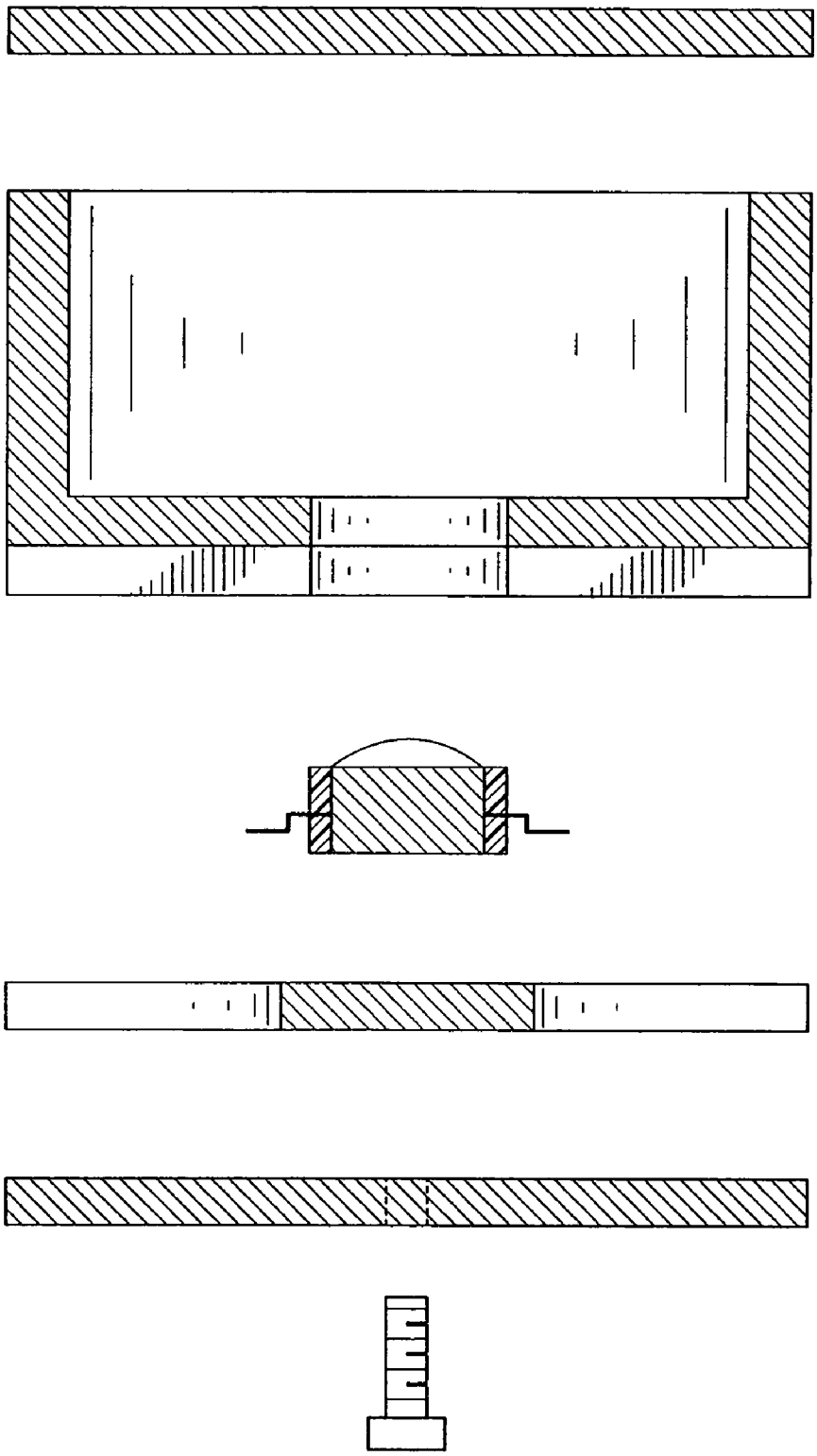
FIG. 12 is a cross-sectional view thereof as taken along line 12—12 of FIG. 11.

Turning now to FIGS. 11 and 12, a second alternate embodiment is shown where the slot is replaced with a circular hole 202 that receives a Luxeon type LED 12 emitter. Further, a lens 204 is shown for purposes of illustration. In all other respects this particular embodiment is operationally the same as the one described above. It should be note that relief areas 206 are provided in the spreader plate 208 that are configured to correspond to the electrical leads 22 of the LED 12 being used in the assembly. In this manner, the contacts 22 can be connected to the circuit board 210 without contacting the spreader plate 208.

Figure 13:
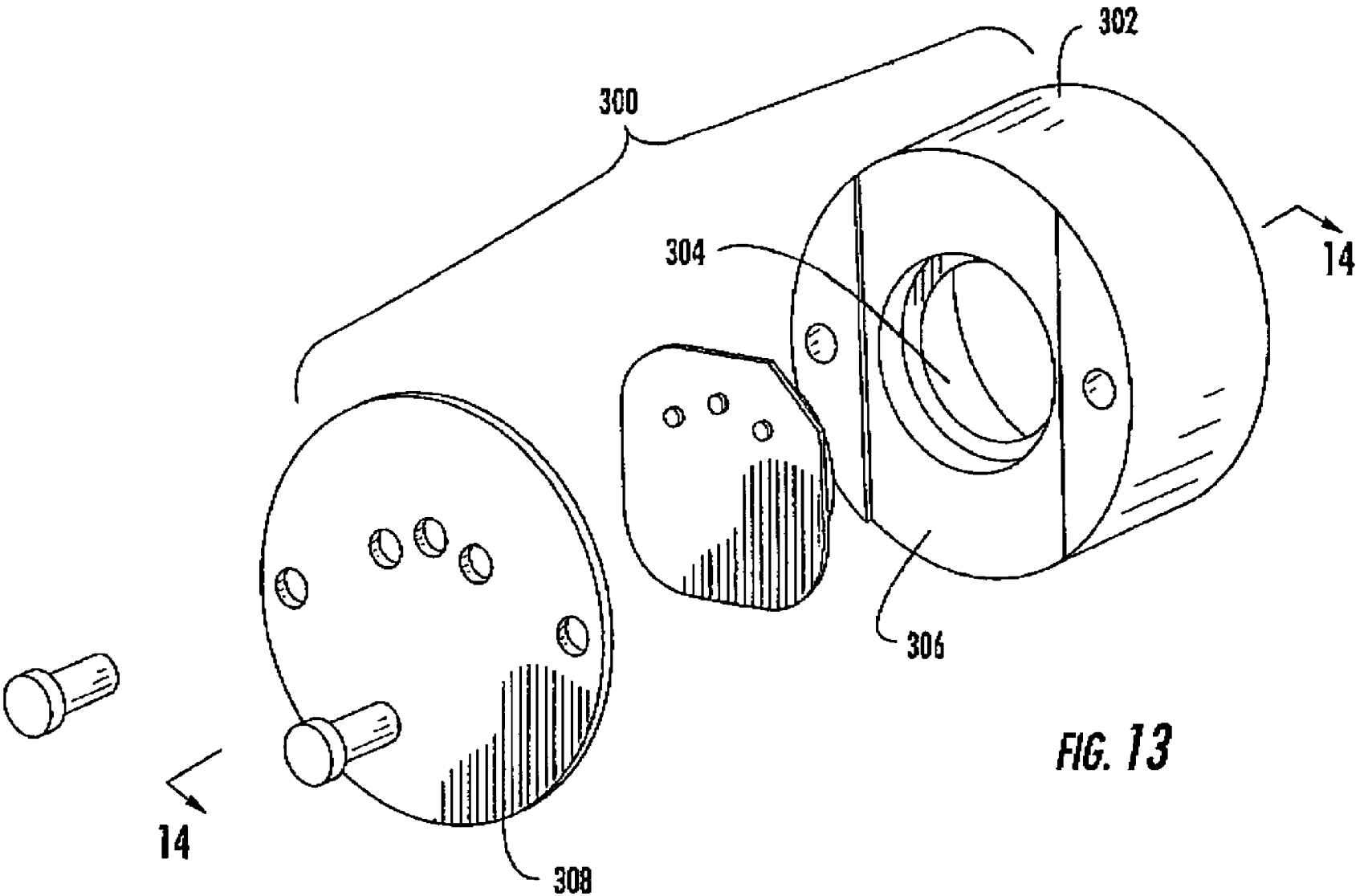
FIG. 13 is an exploded perspective view of a third alternate embodiment of the present invention.
Figure 14:
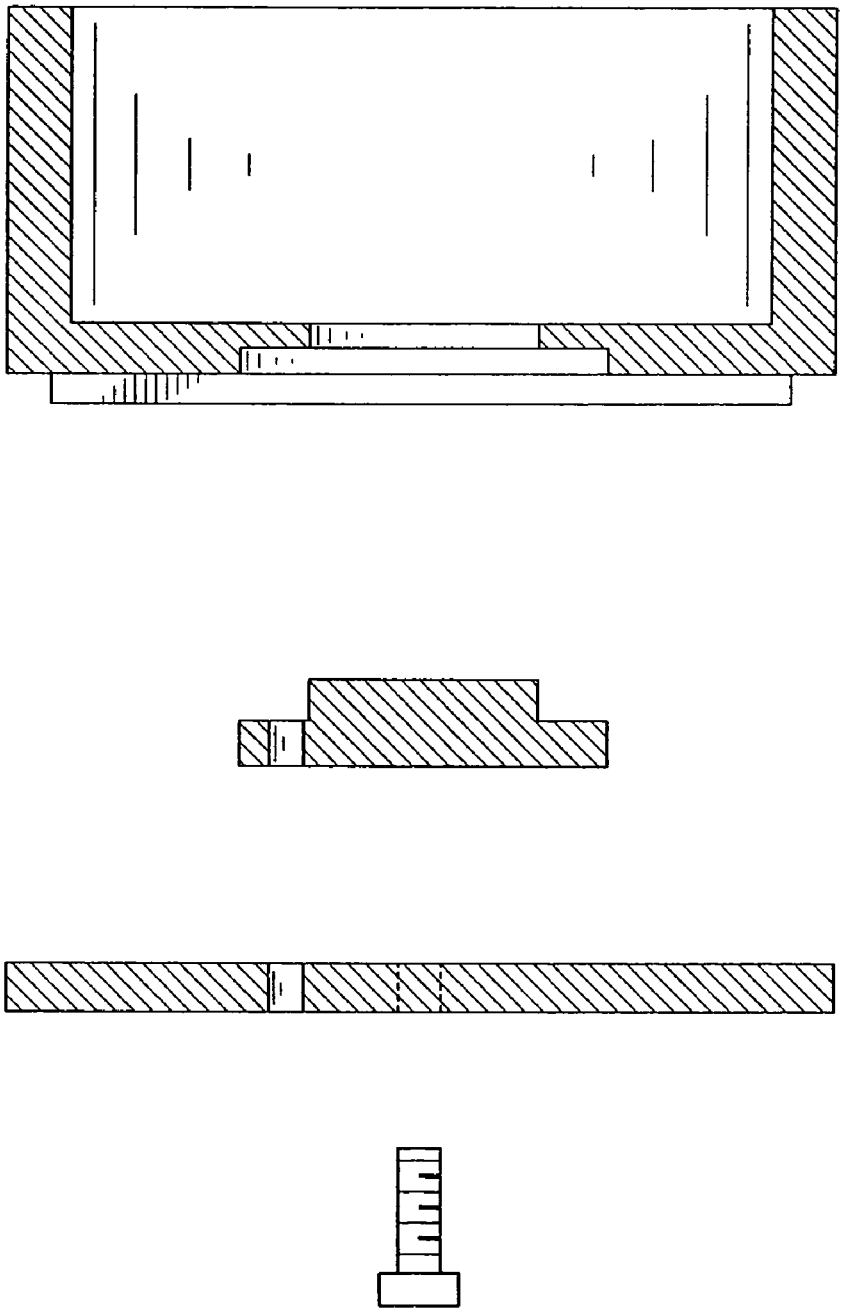
FIG. 14 is a cross-sectional view thereof as taken along line 14—14 of FIG. 13.

Turning to FIGS. 13 and 14, a third alternate embodiment of the LED assembly 300 Is shown. The reflector cup 302 includes both a circular hole 304 and a slot 306 in the rear thereof. The important aspect of the present invention is that the spreader plates 110, 210 or 308 are in flush thermal communication with both the rear surface of the LED 12 and the rear surface of the reflector cups 102, 200 and 302 to allow the heat to be transferred from the LED 12 to the reflector cup 102, 200 and 302.

Figure 15:
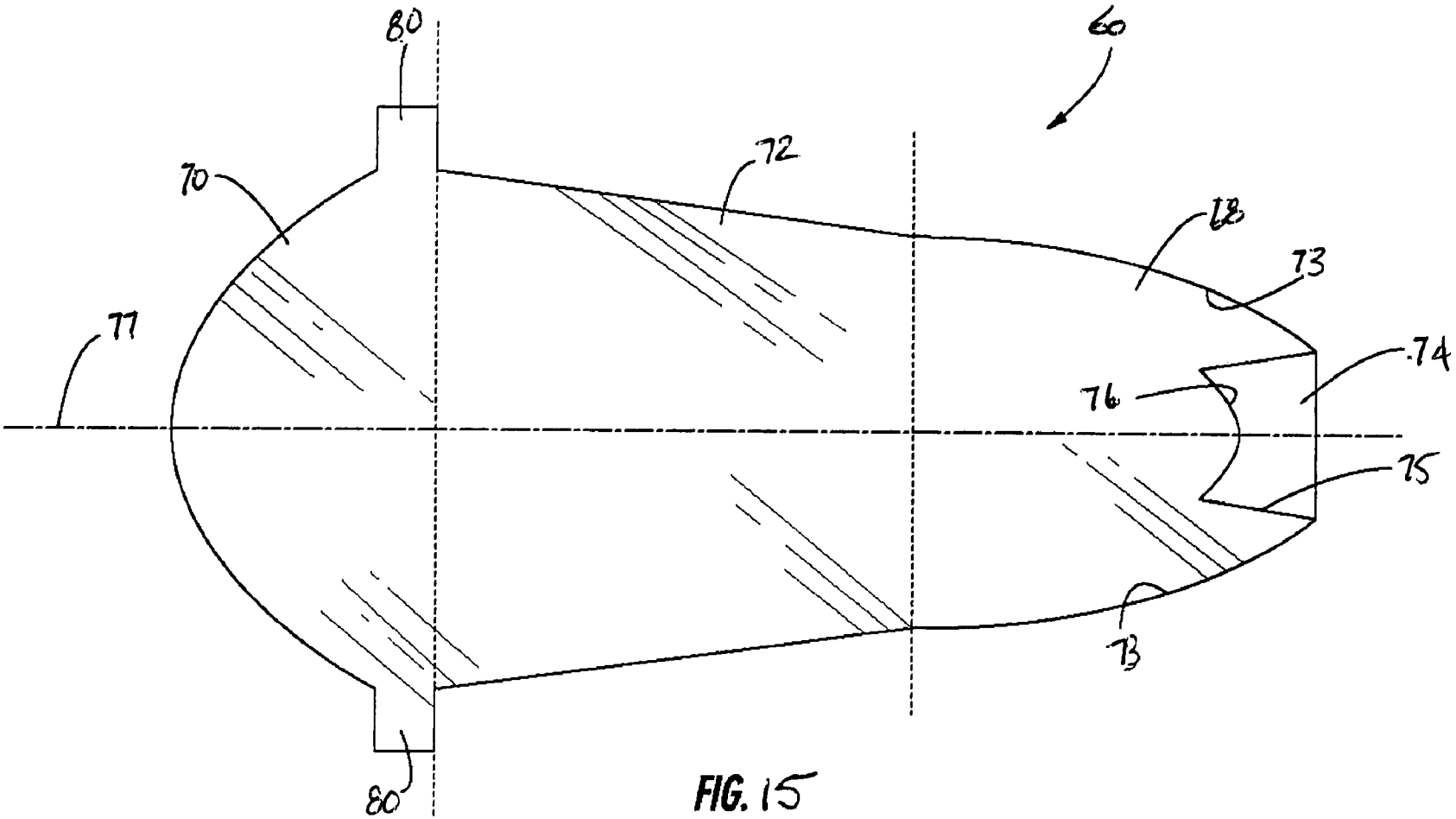
FIG. 15 is a cross-sectional view of the optical lens of the present invention.

FIG. 15 illustrates the unique lens configuration 60 of the present invention. The lens 60 can be seen to generally include a total internal reflection (TIR) collector portion 68, a projector lens portion 70 and a transition portion 72 disposed between the collector 68 and the projector 70. As will hereinafter be more fully described, the lens 60 is configured to capture a large amount of the available light from a light source 12, collimate the output and redirect it in a forward fashion to provide a uniformly illuminated circular beam image in the far field of the device. In general the lens 60 of the present invention can be used with any compact light source 12 to provide a highly efficient lens assembly that is convenient and economical for assembly and provides a high quality light output that has not been previously available in the prior art.

Figure 1B:
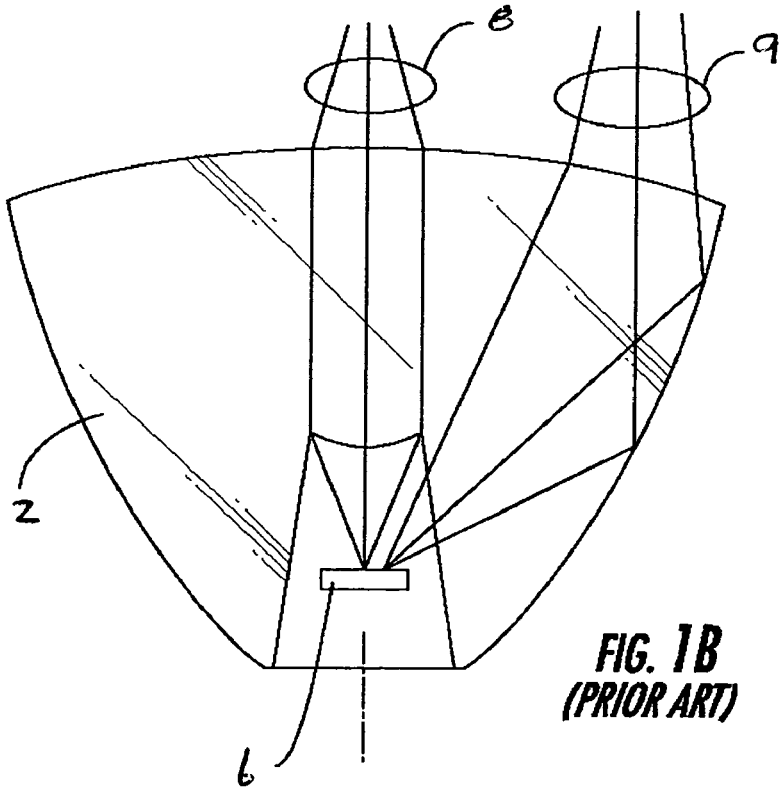
FIG. 1B (PRIOR ART)
FIG. 1B is a cross-sectional view of a prior art catadioptric lens showing ray traces from a high intensity LED source.

Turning back to FIGS. 1*a* and 1*b* , as stated above, the catadioptric lenses 2 of the prior are designed to operate with theoretical point sources 4. By following the ray traces shown in FIG. 1*a* , it can be seen that a highly focused beam output 7 is generated when the output source is a theoretical point source 4. However, while many high intensity light sources 12 theoretically approximate a point source, in practice, when the output energy is captured and magnified, the light source 12 actually operates as an extended light source 6. As can be best seen in FIG. 1*b* , a high intensity light emitting diode (LED) 6 is shown in combination with the prior art catadioptric lens 2. The resulting ray traces clearly illustrate that the output includes a central hot spot 8 that is essentially a projected image of the emitter chip 6, resulting from the finite size of the chip 6 and a halo region 9 that results from the emissions from the sides of the chip 6.

Figure 16:
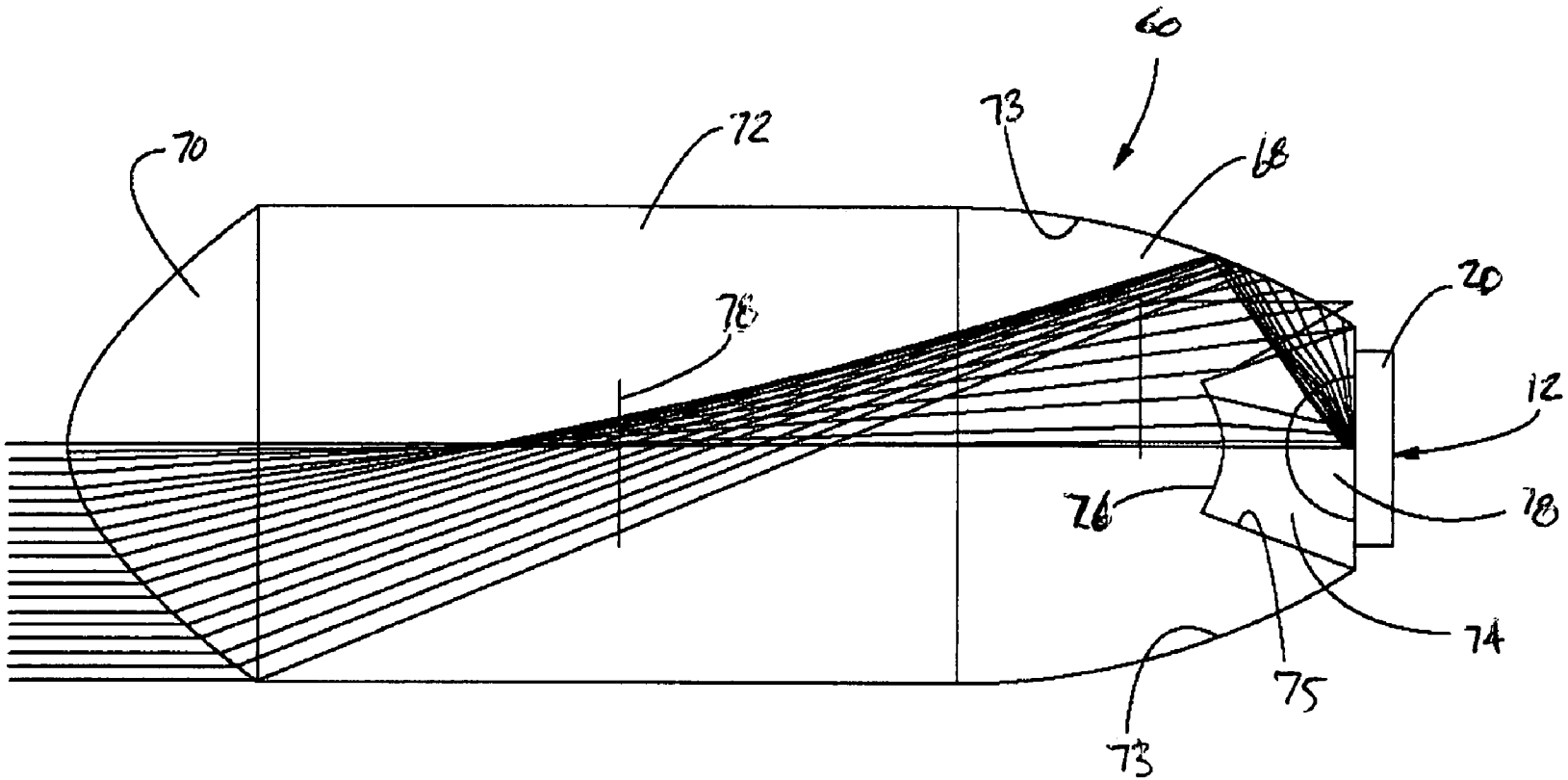
FIG. 16 is a cross-sectional view thereof in conjunction with a light source and ray tracing.

The lens 60 of the present invention is shown in cross-sectional view in FIGS. 15 and 16. The preferred embodiment of the present invention generally includes a TIR collector portion 68, a projector lens portion 70 and a transition section 72 disposed therebetween. The collector portion 68 is configured generally in accordance with the well-known principals of TIR optics. This avoids having to add a reflective coating on the outer surface 73. The collector portion 68 has an outer curved or tapered surface 73 that roughly approximates a truncated conical section. The outer surface 73 may be a straight linear taper, a spherical section, a hyperbolic curve or an ellipsoidal curve. As illustrated in FIG. 15, an ellipsoidal shape has been demonstrated as the most highly efficient shape for use with the preferred high intensity LED light source 12 as will be further described below. The collector 68 includes a recess 74 in the rear thereof that is configured to receive the optical portion 18 of the light source 12. The recess 74 has inner sidewalls 75 and a front wall 76. The inner sidewalls 75 may be straight and parallel or tapered to form a truncated conic section, although some taper is typically required to ensure that the device is moldable. The inner sidewalls 75 act to bend rays toward the collector portion 68 and enhance the collection efficiency of the device. The outer surface 73 and the inner sidewalls 75 are shaped to focus the light from the source within the transition region 72 and near the focal point of the projector lens 70. This generally means that the outer surface 73 will be an asphere, although a true conic shape can be used with only moderate reduction in performance.

The front wall 76 of the recess 74 may be flat or rearwardly convex. In the preferred embodiment, the front wall 76 is formed using an ellipsoidal curve in a rearwardly convex manner. The preferred light source 12 is a high intensity LED device having a mounting base 20, an optical front element 18 and an emitter chip. Generally, LED packages 12 such as described are available in outputs ranging between one and five watts. The drawback is that the output is generally released in a full 180° hemispherical pattern. The light source 12 in accordance with the present invention is placed into the cavity 74 at the rear of the collector 68 and the collector portion 68 operates in two manners. The first operation is a generally refractive function. Light that exits the light source 12 at a narrow exit angle that is relatively parallel to both the optical axis 77 of the lens 60 and the central axis of the light source 12 is directed into the convex lens 76 at the front wall of the cavity 74. As this on axis 77 light contacts the convex surface 76 of the front wall, it is refracted and bent slightly inwardly towards the optical axis 77 of the lens 60, ultimately being relatively collimated and homogenized as it reaches the focal point 78 of the collector portion 68.

The second operation is primarily reflective. Light that exits the light source 12 at relatively high output angle relative to the optical axis 77 of the lens 60 travels through the lens 60 until it contacts the outer walls 73 of the collector section 68. The outer wall 73 is disposed at an angle relative to the light exiting from the light source 12 as described above to be above the optically critical angle for the optical material from which the lens 60 is constructed. The angle is measured relative to the normal of the surface so that a ray that skims the surface is at 90 degrees. As is well known in the art, light that contacts an optical surface above its critical angle is reflected and light that contacts an optical surface below its critical angle has a transmitted component. The light is redirected in this manner towards the optical axis 77 of the lens 60 assembly and the focal point 78 of the collector portion 68. The curve of the outer wall 73 and the curve of the front surface 76 of the cavity 74 are coordinated to generally direct the collected light toward a single focal point 78. In this manner nearly 85% of the light output from the light source 12 is captured and redirected to a homogenized, focused light bundle that substantially converges at the focal point 78 of the collector portion 68 to produce a highly illuminated, substantially circular, light source distribution.

It is important as is best shown in FIG. 16, that a parallel fan of rays traced from the output face of the lens 60 back towards the source 12 will be distributed across nearly the entire face of the source 12. This manner of using a parallel fan of rays and applying them in a reverse manner through the lens 60 and back to the source 12 is important because the distribution of the rays will indicate whether the optical design of the lens will maximize the on axis intensity of the output beam. The prior art was focused on high collection efficiency and no attempt was made to minimize the fraction of the reverse distributed rays that miss the source 12. The disclosed lens 60 device using a combination of a TIR collector 68 and a projector portion 70 provides this important maximum on-axis intensity advantage, especially when one considers that the angle of inner surface 73 is particularly tailored such that these rearward traced rays that ordinarily just skim the surface of the source 12 are now better focused to cover the entire face of the source 12. Further, this aspect of the lens 60 of the present invention is a novel disclosure that is equally useful with respect to a unitary lens 60 or a lens 60 that is formed in two spaced pieces using a collector portion 68 and a projector portion 70 without a transition section 72.

In the lens 60 configuration of the present invention, the placement of the projector portion 70 of the device relative to the collector portion 68 of the device is critical to the proper operation of the lens 60. The projector portion 70 must be placed at a distance from the collector portion 68 that is greater than the focal length 78 of the collector 68. In this manner, the collector 68 can function as described above to focus and homogenize a substantial portion of the light output from the light source 12 into a high intensity, circular, uniformly illuminated near field image. This near field image is produced at a location on the interior of the transition section 72. The near field image is in turn captured by the projector lens 70 and re-imaged or projected into the far field of the device as a uniform circular beam of light as illustrated in FIG. 17*b* . The transitional portion 72 simply serves as a solid spacer to maintain the ideal relationship between the collector portion 68 and the projector portion 70. This configuration eliminates the prior art approach where two separate devices were employed that had to be spaced apart during the assembly process.

The novelty of the lens 60 is that the entire lens 60 structure is formed in a single unitary lens 60 from either a glass material or an optical grade polymer material such as a polycarbonate. In this manner, a compact device is created that has a high efficiency with respect to the amount of light output that is captured and redirected to the far field of the device and with respect to the assembly of the device. This simple arrangement eliminates the prior art need for combination reflectors, lenses, retention rings and gaskets that were required to accomplish the same function. Further, as can best be seen in FIG. 15 the lens 60 may include an annular ring 80 that lies outside the optically active region of the lens 60. The annular ring 80 forms a mounting surface for installing and retaining the lens 60 in the lighting assembly 1 without affecting the overall operation of the device.

Figure 17A:
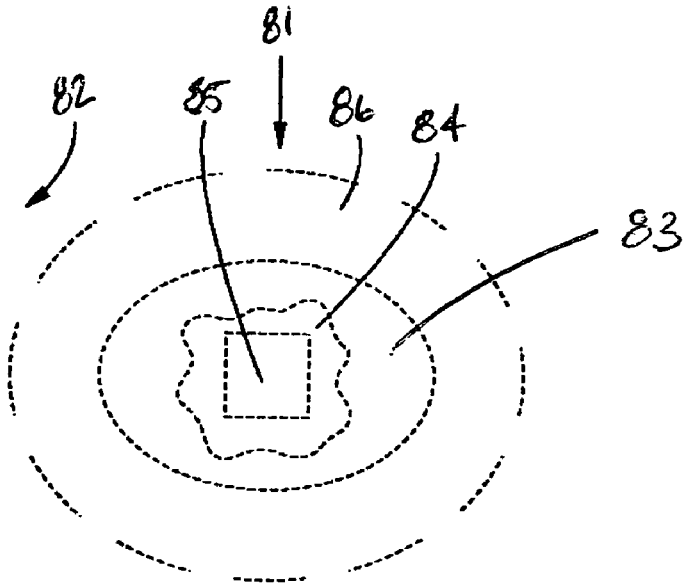
FIG. 17A (PRIOR ART)
FIG. 17*a* is a plan view showing the light beam pattern of a prior art lighting assembly.
Figure 17B:
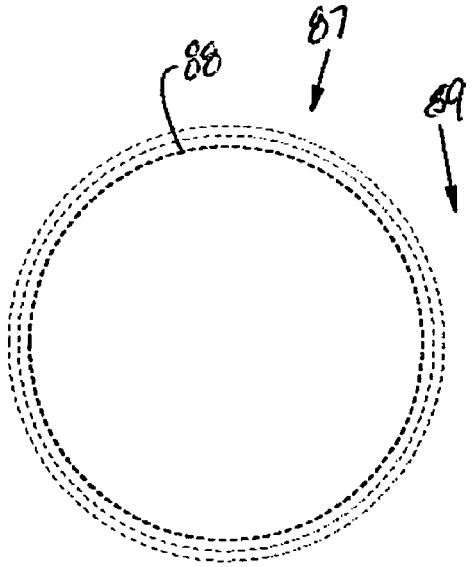
FIG. 17*b* is a plan view showing the light beam pattern of the present invention.

Turning to FIGS. 17*a* and 17*b* , images from a prior art conventional LED flashlight using a standard piano convex lens (FIG. 17*a* ) and from a light source in conjunction with the lens of the present invention (FIG. 17*b* ) are shown adjacent to one another for comparison purposes. The image in FIG. 17*a* can be seen to have poor definition in the transition zone 86 between the illuminated 81 and non-illuminated 82 field areas and an uneven intensity of light can be seen over the entire plane of the illuminated field 81. Areas of high intensity 83 can be witnessed around the perimeter of the illuminated field 81 and in an annular ring 84 near the center of the field 81. In addition, a particularly high intensity area of illumination can be seen in a square box 85 at the center of the field 81 and corresponds to the location of the emitter chip within the LED package. In contrast, FIG. 17*b* shows an image from the present invention. Note that the illuminated field 87 has a uniform pattern of illumination across the entire plane and the edge 88 between the illuminated 87 and non-illuminated 89 fields is clear and well defined providing high levels of contrast. The relationship between the LED and optical lens components are critical to the operation of the present invention and in providing the results shown in the illumination field in FIG. 17*b*.

Figure 18A:
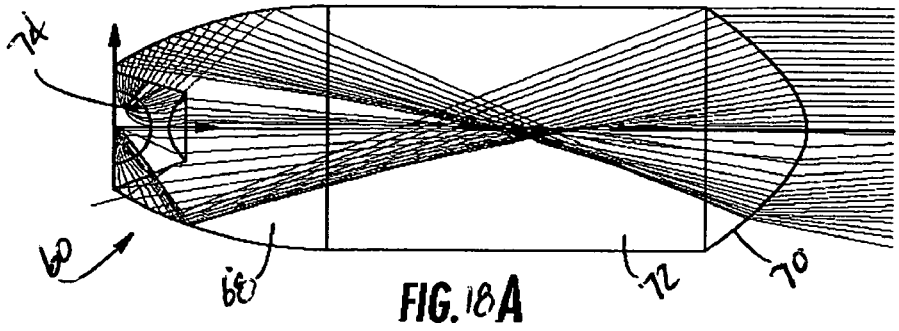
FIG. 18*a* is a side view of the optical lens of the present invention.
Figure 18B:
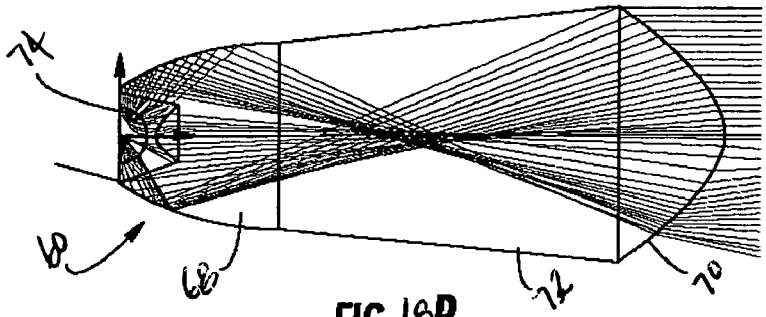
FIG. 18*b* is a side view of a first alternate embodiment thereof.
Figure 18C:
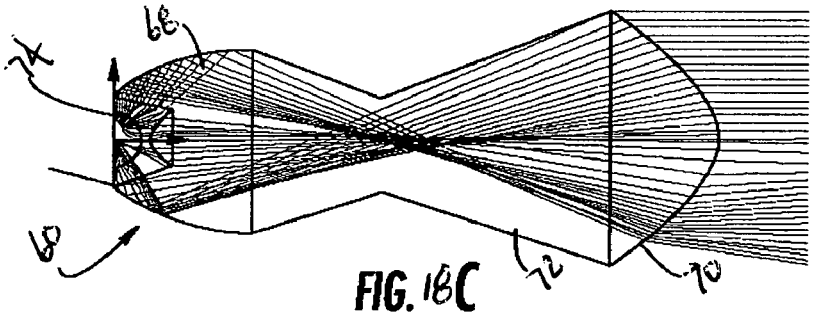
FIG. 18*c* is a side view of a second alternate embodiment thereof.
Figure 19:
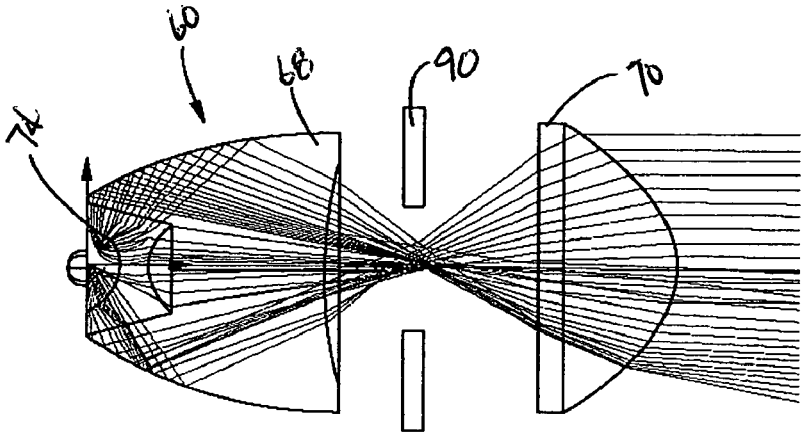
FIG. 19 is a side view thereof shown with an aperture stop.

Since the transition portion 72 of the lens 60 is optically inactive, the shape can vary to suit the particular application for the lens 60. FIGS. 18*a* , 18*b* and 18*c* show several different shapes that the transition section 72 can be formed into without affecting the overall performance of the lens 60. FIG. 18*a* shows that the transition section 72 is simply a straight-sided cylinder. FIG. 18*b* shows the walls having a slight taper. FIG. 18*c* shows the center of the transition section 72 pinched at approximately the focal point 78 of the collector section 72. In this manner, the edges of the light image may be further controlled and the material required to form the lens 60 can be reduced. FIG. 19 illustrates the use of an aperture stop 90 to further control the shape of the beam image. The stop 90 may form a perfect circle to clip the edges of the beam and make a sharp near field image that is captured and transferred to the far field by the projector portion 70. As can be appreciated this aperture stop 90 could also be formed into many other shapes to create novel beam outputs such as stars, hearts, etc.

Figure 20A:
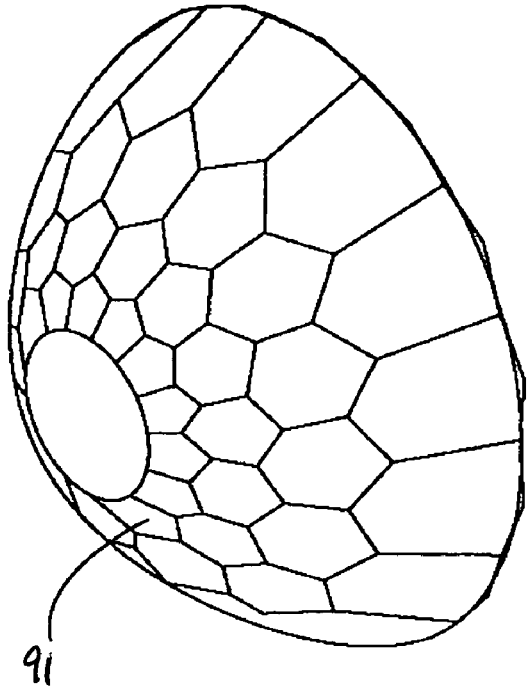
FIG. 20*a* is a front perspective view of the front surface of the present invention with honeycomb facets shown thereon.
Figure 20B:
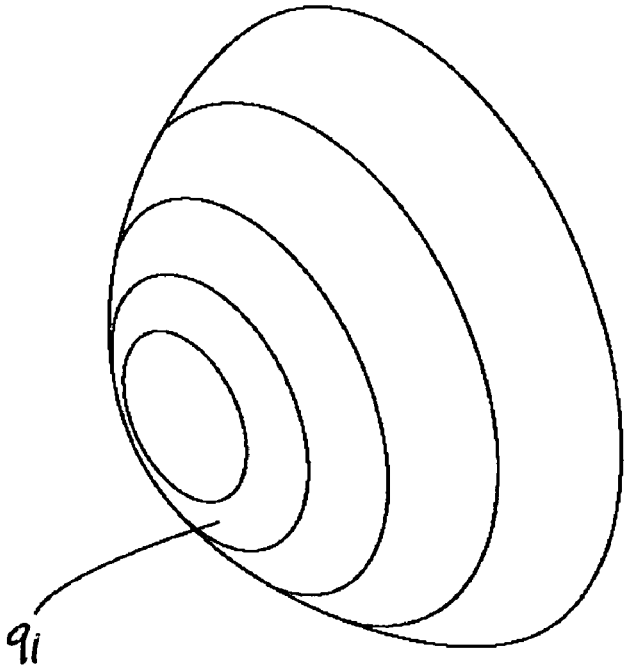
FIG. 20*b* is a front perspective view of the front surface of the present invention with circular facets shown thereon.

To further homogenize the beam output and create a more uniform far field image, the front face 91 of the projector section 70 may include facets. FIGS. 20*a* and 20*b* illustrate two possible facet configurations. FIG. 20*a* shows a honeycomb facet pattern and FIG. 20*b* shows a concentric circular facet pattern. As is well known in the art the facets serve to smear the light image thereby having a homogenizing effect on the overall output image that levels out beam hot spots.

It can therefore be seen that the present invention provides a compact lighting assembly 1 that provides an integrated heat sink LED sub-assembly 10 coupled with a lens 60 configuration that includes integral reflector 68 and projector 70 components that cooperate in a highly efficient manner to gather the diffuse light output from a high intensity light source 12. Further, the present invention operates in an efficient manner to collimate and homogenize the light output thereby forming a highly desirable uniform and circular far field beam image while dissipating waste heat from a high intensity LED source 12 that has been previously unknown in the art. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A lighting assembly comprising:

a light emitting diode package including:

a front luminescent portion having a central axis, a mounting base, a heat transfer plate on a rear surface of said mounting base, and a first and second contact lead extending from the sides of said mounting base;

a heat sink assembly including:

a mounting die having a first end, a second end opposite said first end, a longitudinal axis extending between said first and second ends and an alignment guide on said first end, said mounting die being electrically conductive and thermally conductive, wherein said alignment guide positions said light emitting diode package such that said central axis of said luminescent portion is substantially aligned with said longitudinal axis of said mounting die and said heat transfer plate is in thermal communication with said mounting die; and a lens received adjacent said luminescent portion of said light emitting diode package for directing light output from said light emitting diode package forwardly along an optical axis.

2. The light emitting diode lighting assembly of claim 1, further comprising:

an aperture in said mounting die extending from said first end of said mounting die to said second end, wherein said first contact lead of said light emitting diode is in electrical communication with said mounting die and said second contact lead of said light emitting diode extends into said aperture.

3. The light emitting diode lighting assembly of claim 2, further comprising:

a circuit board mounted adjacent said second end of said mounting die, said circuit board including electrical circuit traces printed on one side thereof, said second contact lead of said light emitting diode in electrical communication with said circuit traces.

4. The light emitting diode lighting assembly of claim 3, wherein said circuit board includes control circuitry in electrical communication with said circuit traces.

5. The light emitting diode lighting assembly of claim 3, further comprising:

an exterior enclosure, said exterior enclosure having a tubular outer wall, said outer wall forming a cavity for receiving and maintaining said mounting die, said light emitting diode and said lens in assembled relation; and a power source having first and second contact leads, said first contact lead in electrical communication with said mounting die and said second contact lead in electrical communication with said circuit traces.

6. The light emitting diode lighting assembly of claim 1, said lens including, a total internal reflection collector portion, said collector portion of said lens comprising:

a rear surface;

an outer side wall; and a cavity extending into said collector portion from said rear surface, said cavity having an inner side wall and a front wall, said front luminescent portion disposed substantially within said cavity.

7. The light emitting diode lighting assembly of claim 1, further comprising:

an exterior enclosure, said exterior enclosure having a tubular outer wall, said outer wall forming a cavity for receiving and maintaining said mounting die, said light emitting diode and said lens in assembled relation; and means for connecting a power source having first and second contact leads with said first and second contact leads of said light emitting diode.

8. A lighting assembly comprising:

a light emitting diode package including:

a front luminescent portion having a central axis, a mounting base, a heat transfer plate on a rear surface of said mounting base, and a first and second contact lead extending from the sides of said mounting base;

an interior mounting die having a first end, a second end opposite said first end and a longitudinal axis extending between said first and second ends, said interior die being electrically conductive and thermally conductive, said interior die having a recess in a first side thereof configured to receive and retain said mounting base of said light emitting diode, wherein said central axis of said luminescent portion is substantially aligned with said longitudinal axis of said interior die and said heat transfer plate is in thermal communication with said first side of said interior die, said interior die having at least one aperture therein extending from said first side of said interior die to a second side of said interior die opposite said first side, one of said contact leads of said diode extending into said aperture;

a lens for directing light output from said light emitting diode forwardly along an optical axis, said lens including, a total internal reflection collector portion, said collector having a recess therein where in said luminescent portion of said light emitting diode is received within said recess; and an exterior enclosure, said exterior enclosure having a tubular outer wall, said outer wall forming a cavity for receiving and maintaining said interior mounting die, said light emitting diode and said lens in assembled relation.

9. The light emitting diode lighting assembly of claim 8, further comprising:

a mounting board installed adjacent said second side of said interior mounting die.

10. The light emitting diode lighting assembly of claim 9, wherein said mounting board is a circuit board with electrical circuit traces printed on one side thereof, said second contact lead of said light emitting diode in electrical communication with said circuit traces.

11. The light emitting diode lighting assembly of claim 10, wherein said circuit board includes control circuitry in electrical communication with said circuit traces.

12. The light emitting diode lighting assembly of claim 8, further comprising:

a power source having first and second contact leads, said first contact lead in electrical communication with said mounting die and said second contact lead in electrical communication with said second contact of said light emitting diode.

13. A light emitting diode lighting assembly comprising:

a light emitting diode having a front luminescent portion having a central axis and a mounting base, said mounting base having a heat transfer plate on a rear surface thereof and a first and second contact lead extending from the sides thereof;

a heat sink assembly, said heat sink assembly being thermally conductive, said heat sink assembly having a front surface and a rear surface, said heat sink assembly having a longitudinal axis extending from said front surface to said rear surface, an alignment guide in said rear surface thereof and an aperture extending from said alignment guide to said front surface of said heat sink, said alignment guide being configured to receive said mounting base of said light emitting diode, wherein said luminescent portion of said tight emitting diode extends through said aperture and said central axis is in substantial alignment with said longitudinal axis;

a spreader plate, said spreader plate being thermally conductive, said spreader plate in thermal communication with said heat transfer plate of said light emitting diode and said rear surface of said heat sink assembly, wherein said spreader plate retains said light emitting diode in said alignment guide and conducts heat from said light emitting diode to said heat sink assembly; and a lens for directing light output from said light emitting diode forwardly along an optical axis, said lens including a total internal reflection collector portion at a first end thereof, said collector having a focal length and a recess therein where in said luminescent portion of said light emitting diode is received within said recess.

14. The light emitting diode lighting assembly of claim 13, further comprising:

a circuit board adjacent to said spreader plate, said circuit board in electrical communication with said first and second contact leads of said light emitting diode.

15. The light emitting diode lighting assembly of claim 13, said collector portion of said lens comprising:

a rear surface;

an outer side wall; and a cavity extending into said collector portion from said rear surface, said cavity having an inner side wall and a front wall, said light source disposed substantially within said cavity.

* * * * *